US007971369B2

(12) United States Patent
Studebaker

(10) Patent No.: US 7,971,369 B2
(45) **Date of Patent: *Jul. 5, 2011**

(54) SHROUDED FLOOR DRYING FAN

(76) Inventor: Roy Studebaker, Centralia, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/364,115

(22) Filed: Feb. 28, 2006

(65) Prior Publication Data

US 2006/0143936 A1 Jul. 6, 2006

Related U.S. Application Data

(62) Division of application No. 10/951,294, filed on Sep. 27, 2004, now Pat. No. 7,007,403.

(51) Int. Cl.
*F26B 19/00* (2006.01)

(52) U.S. Cl. ..... 34/380; 34/402

(58) Field of Classification Search ..... 34/380, 34/402, 413, 497; 454/187, 190; 415/209.3, 415/198.1; 432/114; 95/273; 165/301
See application file for complete search history.

(56) References Cited

U.S. PATENT DOCUMENTS

| | | | | | |
|---|---|---|---|---|---|
| 108,949 | A | | 11/1870 | Wheeler | |
| 1,345,055 | A | | 6/1920 | Willour | |
| 1,697,454 | A | * | 1/1929 | Brown et al. | 34/535 |
| 1,968,874 | A | * | 8/1934 | Forrest | 34/191 |
| 2,045,319 | A | * | 6/1936 | Watrous | 34/428 |
| 2,100,994 | A | | 11/1937 | Cohen | |
| 2,138,049 | A | * | 11/1938 | Vesce | 34/338 |
| 2,266,640 | A | * | 12/1941 | Joyce | 34/588 |
| 2,229,592 | A | | 10/1942 | Rober | |
| 2,344,266 | A | | 3/1944 | Reissner | |
| 2,399,555 | A | * | 4/1946 | Locke | 34/131 |
| 2,493,253 | A | * | 1/1950 | Somerville | 34/652 |
| 2,514,487 | A | | 7/1950 | Griese | |
| 2,521,920 | A | | 9/1950 | Koch | |
| 2,546,867 | A | * | 3/1951 | Peck | 264/141 |
| 2,576,294 | A | | 11/1951 | Geraci | |
| 2,601,080 | A | * | 6/1952 | Andrews, Jr. | 34/463 |
| 2,758,392 | A | * | 8/1956 | James et al. | 34/229 |
| 2,830,384 | A | * | 4/1958 | Zehrbach | 34/604 |

(Continued)

FOREIGN PATENT DOCUMENTS

DE 3326560 A1 * 2/1985

(Continued)

OTHER PUBLICATIONS

Catalog page entitled: Dri-Eaz Ace Turbodryer—Stackable Airmover, from web site: www//drieaz.com/Ace. html, dated Oct. 4, 2002.

(Continued)

*Primary Examiner* — S. Gravini
(74) *Attorney, Agent, or Firm* — Charles J. Rupnick Attorney at Law

(57) ABSTRACT

A method and apparatus for drying floors and carpets using a fan for generating a pressurized air stream within a vertical cylindrical shroud that is spaced two to five inches away from the floor on a set of legs such that an opening is formed between the shroud and the floor. The air stream is directed along the cylindrical shroud vertically toward the floor. At least a peripheral portion of the air stream is exhausted from the shroud in a substantially laminar flow at an angle that is inclined from the vertical and is exhausted radially into ambient air as a substantially laminar air stream.

18 Claims, 15 Drawing Sheets

U.S. PATENT DOCUMENTS

| | | | | | |
|---|---|---|---|---|---|
| 2,830,779 | A | | 4/1958 | Wentling | |
| 2,832,986 | A | * | 5/1958 | Seck | 15/327.3 |
| 2,868,558 | A | | 1/1959 | Krauss | |
| 2,941,309 | A | * | 6/1960 | Cobb | 34/60 |
| 2,954,613 | A | * | 10/1960 | Baker | 34/102 |
| 3,087,255 | A | * | 4/1963 | Morrow | 34/167 |
| 3,161,481 | A | * | 12/1964 | Edwards | 34/527 |
| 3,176,412 | A | * | 4/1965 | Gardner | 34/122 |
| 3,228,115 | A | * | 1/1966 | Swanson et al. | 34/591 |
| 3,230,636 | A | * | 1/1966 | Daane | 34/122 |
| 3,235,971 | A | * | 2/1966 | Tooby | 34/256 |
| 3,273,256 | A | * | 9/1966 | Behrens | 34/546 |
| 3,328,894 | A | * | 7/1967 | Smith, Jr. | 34/583 |
| 3,345,756 | A | * | 10/1967 | Bryand et al. | 34/454 |
| 3,390,465 | A | * | 7/1968 | Wise | 34/354 |
| 3,391,470 | A | * | 7/1968 | Conkling | 34/99 |
| 3,486,241 | A | * | 12/1969 | Coyle et al. | 34/540 |
| 3,551,970 | A | * | 1/1971 | Cohn et al. | 26/91 |
| 3,585,734 | A | * | 6/1971 | Barton et al. | 34/116 |
| 3,605,272 | A | * | 9/1971 | Boucher | 34/261 |
| 3,626,601 | A | * | 12/1971 | Moore | 34/90 |
| 3,680,218 | A | * | 8/1972 | Belue et al. | 34/372 |
| 3,681,851 | A | * | 8/1972 | Fleming | 34/291 |
| 3,688,354 | A | * | 9/1972 | Cohn et al. | 26/52 |
| 3,733,900 | A | * | 5/1973 | De Baun | 73/861.66 |
| 3,787,986 | A | * | 1/1974 | Burger | 34/229 |
| 3,808,698 | A | * | 5/1974 | Peters | 34/500 |
| 3,823,877 | A | * | 7/1974 | Poggie | 241/19 |
| 3,849,900 | A | * | 11/1974 | Dale et al. | 34/368 |
| 3,863,360 | A | * | 2/1975 | Stievenari et al. | 34/632 |
| 3,899,836 | A | * | 8/1975 | Johnson | 34/225 |
| 3,923,482 | A | * | 12/1975 | Knab et al. | 55/412 |
| 3,932,946 | A | * | 1/1976 | Johnson | 34/201 |
| 3,934,005 | A | * | 1/1976 | Albert | 514/477 |
| 4,022,548 | A | | 5/1977 | McLarty | |
| 4,035,928 | A | * | 7/1977 | Sietmann et al. | 34/174 |
| 4,094,630 | A | * | 6/1978 | Turner | 432/134 |
| 4,106,215 | A | * | 8/1978 | Rosen | 34/217 |
| 4,120,615 | A | | 10/1978 | Keem et al. | |
| 4,130,381 | A | | 12/1978 | Levin et al. | |
| 4,188,878 | A | * | 2/1980 | Kuhnau | 100/212 |
| D254,566 | S | | 3/1980 | Cummins | |
| 4,193,209 | A | * | 3/1980 | Lovison et al. | 34/239 |
| 4,203,229 | A | * | 5/1980 | Southworth | 34/538 |
| 4,224,743 | A | * | 9/1980 | Erickson et al. | 34/219 |
| 4,236,871 | A | | 12/1980 | Hirst et al. | |
| 4,239,459 | A | | 12/1980 | Felter | |
| 4,260,373 | A | * | 4/1981 | Fellnor et al. | 432/110 |
| 4,350,502 | A | * | 9/1982 | Spatola | 95/142 |
| 4,352,249 | A | * | 10/1982 | Rose | 34/212 |
| 4,358,341 | A | * | 11/1982 | Bergquist | 159/4.08 |
| 4,374,319 | A | * | 2/1983 | Guibert | 219/400 |
| 4,378,640 | A | * | 4/1983 | Buchholz | 34/632 |
| 4,412,392 | A | * | 11/1983 | Keller | 34/233 |
| 4,471,213 | A | * | 9/1984 | Yoshida | 392/379 |
| RE31,765 | E | * | 12/1984 | Guibert | 219/400 |
| 4,506,452 | A | * | 3/1985 | Lillibridge | 34/255 |
| 4,506,655 | A | | 3/1985 | Kuechler | |
| 4,522,160 | A | | 6/1985 | Speers et al. | |
| 4,550,773 | A | * | 11/1985 | Martin | 165/54 |
| 4,571,849 | A | * | 2/1986 | Gardner et al. | 34/79 |
| 4,599,042 | A | | 7/1986 | Colliver | |
| 4,750,993 | A | * | 6/1988 | Donhauser et al. | 209/11 |
| 4,813,153 | A | * | 3/1989 | Palmer et al. | 34/550 |
| 4,832,249 | A | * | 5/1989 | Ehler | 228/102 |
| 4,834,612 | A | | 5/1989 | Lahn et al. | |
| 4,846,399 | A | | 7/1989 | Asselbergs | |
| 4,888,885 | A | * | 12/1989 | Caughey | 34/503 |
| 4,914,833 | A | * | 4/1990 | Pilolla et al. | 34/526 |
| 4,927,328 | A | | 5/1990 | Scoates et al. | |
| 4,928,580 | A | * | 5/1990 | McIntyre et al. | 454/123 |
| 4,999,927 | A | * | 3/1991 | Durst et al. | 34/448 |
| 5,001,966 | A | * | 3/1991 | McIntyre et al. | 454/123 |
| 5,064,614 | A | * | 11/1991 | Reiss et al. | 422/22 |
| 5,105,563 | A | * | 4/1992 | Fingerson et al. | 34/203 |
| 5,161,952 | A | | 11/1992 | Eggers, Jr. | |
| 5,178,094 | A | * | 1/1993 | Carr et al. | 119/6.5 |
| 5,181,329 | A | * | 1/1993 | Devaney et al. | 34/643 |
| 5,199,190 | A | * | 4/1993 | Mayer et al. | 34/235 |
| 5,208,940 | A | | 5/1993 | London et al. | |
| 5,243,683 | A | * | 9/1993 | Yang | 392/379 |
| 5,248,224 | A | | 9/1993 | Amr | |
| 5,265,895 | A | * | 11/1993 | Barrett | 280/47.24 |
| 5,277,652 | A | * | 1/1994 | Minor | 454/52 |
| RE34,551 | E | | 2/1994 | Coup et al. | |
| 5,295,811 | A | | 3/1994 | Chiu | |
| 5,342,175 | A | | 8/1994 | Patton | |
| 5,381,701 | A | * | 1/1995 | Frankenthal et al. | 73/865.6 |
| 5,397,606 | A | * | 3/1995 | Jeffs | 427/542 |
| 5,400,525 | A | * | 3/1995 | Sheley | 34/360 |
| 5,400,908 | A | * | 3/1995 | Prestwood | 209/25 |
| 5,412,881 | A | * | 5/1995 | Romweber et al. | 34/136 |
| 5,439,349 | A | | 8/1995 | Kupferberg | |
| 5,539,958 | A | * | 7/1996 | Cadieux et al. | 19/304 |
| 5,553,347 | A | * | 9/1996 | Inoue et al. | 15/327.3 |
| 5,567,481 | A | * | 10/1996 | Yu et al. | 427/378 |
| 5,590,477 | A | * | 1/1997 | Carfagno, Sr. | 34/235 |
| 5,591,412 | A | * | 1/1997 | Jones et al. | 422/171 |
| 5,613,306 | A | * | 3/1997 | Romweber et al. | 34/136 |
| 5,625,398 | A | * | 4/1997 | Milkovits et al. | 347/104 |
| 5,634,281 | A | * | 6/1997 | Nugent | 34/207 |
| 5,687,542 | A | * | 11/1997 | Lawecki et al. | 53/122 |
| 5,692,556 | A | * | 12/1997 | Hafner | 165/301 |
| 5,709,234 | A | * | 1/1998 | Lashmett et al. | 134/92 |
| 5,797,718 | A | | 8/1998 | Gerling et al. | |
| 5,809,664 | A | * | 9/1998 | Legros et al. | 34/347 |
| 5,822,881 | A | * | 10/1998 | Romweber et al. | 34/136 |
| 5,826,549 | A | | 10/1998 | Martin | |
| 5,857,270 | A | * | 1/1999 | Bria | 34/629 |
| 5,863,155 | A | * | 1/1999 | Segota | 406/61 |
| 5,866,752 | A | * | 2/1999 | Goozner | 204/157.3 |
| 5,913,588 | A | * | 6/1999 | Legros et al. | 34/347 |
| 5,953,884 | A | * | 9/1999 | Lawecki et al. | 53/428 |
| 6,004,384 | A | * | 12/1999 | Caudle | 96/125 |
| 6,016,710 | A | * | 1/2000 | Boles et al. | 73/861.42 |
| 6,018,886 | A | * | 2/2000 | Bell et al. | 34/380 |
| 6,038,786 | A | * | 3/2000 | Aisenberg et al. | 34/267 |
| D422,351 | S | | 4/2000 | Griffin | |
| 6,045,330 | A | | 4/2000 | Williams | |
| 6,094,837 | A | * | 8/2000 | Cantor | 34/97 |
| 6,098,473 | A | * | 8/2000 | Hafner | 73/865.8 |
| 6,099,258 | A | | 8/2000 | Litvin et al. | |
| 6,145,277 | A | * | 11/2000 | Lawecki et al. | 53/428 |
| 6,148,543 | A | * | 11/2000 | Chapman | 34/424 |
| 6,192,766 | B1 | * | 2/2001 | G.ang.rdhagen et al. | 73/863.12 |
| 6,226,891 | B1 | * | 5/2001 | Chapman | 34/508 |
| 6,250,797 | B1 | | 6/2001 | Weetman | |
| 6,257,171 | B1 | * | 7/2001 | Rivard | 119/419 |
| 6,280,507 | B1 | * | 8/2001 | Walker | 95/273 |
| 6,296,449 | B1 | | 10/2001 | Wang | |
| 6,347,937 | B1 | * | 2/2002 | Yearham et al. | 432/114 |
| 6,364,618 | B1 | | 4/2002 | Moreno | |
| 6,390,770 | B1 | | 5/2002 | Takeshita | |
| 6,421,931 | B1 | * | 7/2002 | Chapman | 34/424 |
| 6,435,180 | B1 | * | 8/2002 | Hewson et al. | 128/204.18 |
| 6,438,862 | B1 | * | 8/2002 | Soucy | 34/168 |
| 6,463,674 | B1 | * | 10/2002 | Meyers et al. | 34/304 |
| 6,474,956 | B2 | | 11/2002 | Davis et al. | |
| 6,514,036 | B2 | | 2/2003 | Marshall et al. | |
| 6,550,725 | B1 | | 4/2003 | Watson | |
| 6,564,473 | B2 | * | 5/2003 | Aydore | 34/504 |
| 6,565,334 | B1 | | 5/2003 | Bradbury et al. | |
| 6,571,738 | B2 | * | 6/2003 | Rivard | 119/419 |
| 6,584,936 | B2 | * | 7/2003 | Rivard | 119/419 |
| D480,467 | S | | 10/2003 | White | |
| 6,638,016 | B1 | | 10/2003 | Mease et al. | |
| 6,647,639 | B1 | * | 11/2003 | Storrer | 34/104 |
| 6,692,240 | B1 | | 2/2004 | Leonhard et al. | |
| 6,695,577 | B1 | | 2/2004 | Susek | |
| 6,886,271 | B2 | * | 5/2005 | Storrer | 34/92 |
| 7,007,403 | B1 | * | 3/2006 | Studebaker | 34/90 |
| 7,024,794 | B1 | * | 4/2006 | Mynes | 34/59 |
| 7,140,121 | B2 | * | 11/2006 | Casella et al. | 34/201 |
| 7,201,563 | B2 | * | 4/2007 | Studebaker | 415/209.3 |
| 7,238,006 | B2 | * | 7/2007 | Studebaker | 415/211.2 |
| 7,297,050 | B2 | * | 11/2007 | Bridenne et al. | 454/187 |
| 2002/0043217 | A1 | * | 4/2002 | Rivard | 119/419 |

| | | | | |
|---|---|---|---|---|
| 2003/0051676 | A1 * | 3/2003 | Rivard | 119/419 |
| 2004/0025366 | A1 * | 2/2004 | Soucy | 34/230 |
| 2004/0111912 | A1 * | 6/2004 | Storrer | 34/92 |
| 2004/0198215 | A1 * | 10/2004 | Bridenne et al. | 454/187 |
| 2004/0255484 | A1 * | 12/2004 | Storrer et al. | 34/92 |
| 2006/0051274 | A1 * | 3/2006 | Wright et al. | 423/220 |
| 2006/0054804 | A1 * | 3/2006 | Wexler | 250/282 |
| 2006/0067812 | A1 * | 3/2006 | Studebaker | 415/121.2 |
| 2006/0067818 | A1 * | 3/2006 | Studebaker | 415/198.1 |
| 2006/0071357 | A1 * | 4/2006 | Pilon et al. | 264/4 |
| 2006/0080854 | A1 * | 4/2006 | Mynes | 34/59 |
| 2006/0137211 | A1 * | 6/2006 | Casella et al. | 34/231 |
| 2006/0143936 | A1 * | 7/2006 | Studebaker | 34/90 |
| 2007/0193058 | A1 * | 8/2007 | Zarembinski | 34/202 |
| 2007/0294909 | A1 * | 12/2007 | Abdi et al. | 34/97 |
| 2008/0039005 | A1 * | 2/2008 | Coven | 454/234 |
| 2008/0244975 | A1 * | 10/2008 | Johnston | 48/197 FM |
| 2008/0248343 | A1 * | 10/2008 | Markoski et al. | 429/15 |
| 2008/0256826 | A1 * | 10/2008 | Zarembinski | 34/562 |
| 2009/0165329 | A1 * | 7/2009 | Reichelsheimer et al. | 34/445 |

FOREIGN PATENT DOCUMENTS

| | | | | |
|---|---|---|---|---|
| DE | 3414281 | A1 | * | 10/1985 |
| DE | 3816414 | A1 | * | 11/1989 |
| DE | 4106037 | A1 | * | 8/1992 |
| DE | 4211673 | A1 | * | 10/1993 |
| DE | 4391557 | C1 | * | 3/1999 |
| DE | 19925134 | A1 | * | 12/2000 |
| EP | 1222871 | A1 | * | 7/2002 |
| EP | 1382425 | A2 | * | 1/2004 |
| EP | 1849911 | A1 | * | 10/2007 |
| FR | 2732100 | A1 | * | 9/1996 |
| FR | 2758575 | A1 | * | 7/1998 |
| GB | 2031270 | A | * | 4/1980 |
| GB | 2187546 | A | * | 9/1987 |
| GB | 2242179 | A | * | 9/1991 |
| JP | 54040755 | A | * | 3/1979 |
| JP | 56121609 | A | * | 9/1981 |
| JP | 57079299 | A | * | 5/1982 |
| JP | 58076143 | A | * | 5/1983 |
| JP | 01266893 | A | * | 10/1989 |
| JP | 03160231 | A | * | 7/1991 |
| JP | 06146184 | A | * | 5/1994 |
| JP | 06146185 | A | * | 5/1994 |
| JP | 09113134 | A | * | 5/1997 |
| JP | 2002186826 | A | * | 7/2002 |
| JP | 2003305371 | A | * | 10/2003 |
| JP | 2004105511 | A | * | 4/2004 |
| JP | 2005046661 | A | * | 2/2005 |
| JP | 2005143532 | A | * | 6/2005 |
| JP | 2005305223 | A | * | 11/2005 |
| JP | 2008180100 | A | * | 8/2008 |
| WO | WO 9747933 | A1 | * | 12/1997 |
| WO | WO 9953250 | A1 | * | 10/1999 |
| WO | WO 0021404 | A1 | * | 4/2000 |

OTHER PUBLICATIONS

Catalog page entitled: Dri-Eaz Ace Airmovers for Restorative Drying Professionals, Mar. 2005 web site: www//drieaz.com/Airmovers. html, dated Oct. 4, 2002.

Catalog page entitled: Dri-Eaz Ace Airmovers—Compare Specifications, from web site: www//drieaz.com/AirMoversSpecs. html, dated Oct. 4, 2002.

Catalog page entitled: Dri-Eaz Ace Turbodyer—Stackable Airmover, from web site: www//drieaz.com/Products/ace. html, dated Sep. 13, 2004.

* cited by examiner

SHROUDED FLOOR DRYING FAN

This application claims priority benefit of and is a DIV of parent U.S. patent application Ser. No. 10/951,294 filed in the name of Roy Studebaker on Sep. 27, 2004 now U.S. Pat. No. 7,007,403, the complete disclosure of which is incorporated herein by reference.

FIELD OF THE INVENTION

The present invention relates to a portable electronic fan, and in particular to a shrouded fan for drying floors.

BACKGROUND OF THE INVENTION

Different fans are known for drying floors, carpets and other floor covering. Among these fans is the well-known electrically driven, squirrel-cage blower of the type disclosed in U.S. Pat. No. 5,265,895, Floor Fan Handtruck Apparatus And Method, issued to Barrett on Nov. 30, 1993, the complete disclosure of which is incorporated herein by reference. This type of squirrel-cage blower fan is illustrated in FIG. 1A, generally indicated at 1, having a generally rectangular outlet or "discharge chute" 3 located adjacent the bottom of a blower housing 5 and extending outwardly tangentially from the blower housing and parallel to the floor. The discharge chute 3 allows the operator to direct the blast of air generated by the fan horizontally across the designated area of the floor, as indicated by the arrows. Adjustable risers 7 at the outer end of the discharge chute 3 allow the operator to adjust the angle of the air blast from the discharge chute 3 relative to the floor surface.

FIG. 1B illustrates another type of floor and carpet drying fan disclosed by Larry White in U.S. Design Pat. D480,467, Air Mover, issued on Oct. 7, 2003, and assigned to Dri-Eaz Products, Incorporated of Burlington, Wash., the complete disclosure of which is incorporated herein by reference, which generally teaches an ornamental design for a fan 11 having a generally barrel-shaped molded shroud 13 having smoothly rounded lips 15 at the inlet 17 and outlet orifice 19, each with a protective round wire grille 21. Legs 23 are provided on four sides of the shroud 13 for holding it an undisclosed distance above the floor surface. The blast of air generated by the fan 11 is directed generally parallel with the longitudinal axis of the barrel-shape of the shroud 13, as indicated by the arrow. According to product literature, the fan 11 can be rotated into seven specific different relationships with the floor by rotating the shroud 13 on the legs 23. Each of the legs 23 are provided with coasters 25 on its blunt end and exposed side surfaces, as shown, which are believed to hold the fan 11 in position without imprinting or otherwise damaging the carpet. The molded shroud 13 and legs 23 are also configured for linear stacking of multiple fans 11. A handle 27 is provided on one outside surface of the molded shroud 13 for lifting, carrying and moving the fan 11.

While prior art fan devices such as those described briefly here are useful for drying floors with or without carpeting, such prior art fan devices suffer limitations that limit both their speed and effectiveness in accomplishing the desired goal of drying the work surface, and their ease of operation.

SUMMARY OF THE INVENTION

The present invention is a method for drying floors, carpets and other substantially planar work surfaces that overcomes limitations of the prior art by providing a the method using a fan for generating a pressurized air stream within a confined tubular space, such as a cylindrical shroud, that is oriented substantially perpendicularly to the work surface and spaced away from the work surface, e.g., on a set of legs, for forming a substantially cylindrical opening between the confined space having the pressurized air stream within and the work surface. the air stream is directed along the cylindrical confined space in a direction that is oriented substantially perpendicularly to the work surface. At least a peripheral portion of the air stream is exhausted from the cylindrical confined space in a substantially laminar flow at an angle that is inclined relative to both the exhausting confined space and the work surface; and the peripheral portion of the laminar air stream is exhausted radially into ambient air from the cylindrical opening between the cylindrical confined space and the work surface.

According to one aspect of the invention, the method also provides for exhausting a central portion of the air stream from the cylindrical confined space in a substantially laminar flow at an angle that is substantially perpendicular to the work surface.

According to another aspect of the invention, the method also provides for spacing the cylindrical confined space away from the work space by a distance of two to five inches.

According to another aspect of the invention, the method for exhausting the peripheral portion of the laminar air stream radially into ambient air from the circular opening includes generating a radial envelope of pressurized air adjacent to the work surface.

According to another aspect of the invention, the method for exhausting the peripheral portion of the laminar air stream radially into ambient air from the circular opening also includes containing the air stream substantially within the radial envelope adjacent to the work surface for a distance of at least six feet from the circular opening between the confined space and the work surface.

According to still another aspect of the invention, the method for generating a pressurized air stream within the cylindrical confined space also includes generating the pressurized air stream within a substantially round tubular confined space.

According to another aspect of the invention, the present invention provides a fan for operating the method of the present invention, the fan having a means for forming a substantially cylindrical confined space formed of a substantially cylindrical interior surface having a substantially round inlet orifice formed in one end thereof and a substantially round outlet orifice formed in a second end thereof opposite from the inlet orifice; a means for spacing the outlet orifice from an external work surface to be dried by a substantially uniform offset distance; a means for generating a pressurized air stream within the cylindrical confined space; a means for directing the pressurized air stream toward the outlet orifice; a means for directing at least a portion of the air stream at an angle inclined crosswise to a work surface to be dried; and a means for exhausting at least a portion of the air stream through a substantially cylindrical opening between the outlet orifice and the work surface in a substantially laminar air stream having a substantially radial pattern.

According to another aspect of the fan for operating the method of the invention, the fan also includes a means for imparting a laminar flow character to the portion of the air stream exhausted in the substantially radial pattern.

According to another aspect of the fan for operating the method of the invention, the means for directing the air stream crosswise to the work surface to be dried includes the means for imparting a laminar flow character to the air stream.

According to another aspect of the fan for operating the method of the invention, the means for directing at least a portion of the air stream at an angle inclined crosswise to the work surface to be dried also includes a means for deflecting the portion of the air stream from a perpendicular impact with the work surface.

According to another aspect of the fan for operating the method of the invention, the means for directing at least a portion of the air stream at an angle inclined crosswise to the work surface to be dried also includes the means for exhausting the air stream in a radial pattern through a substantially cylindrical opening between the outlet orifice and the work surface.

According to another aspect of the fan for operating the method of the invention, the means for spacing the outlet orifice a substantially uniform offset distance from the external work surface also includes a means for spacing the outlet orifice an offset distance in the range of two to five inches.

According to another aspect of the fan for operating the method of the invention, the means for spacing the outlet orifice a substantially uniform offset distance from the external work surface further comprises a means for adjusting the substantially uniform offset distance of the outlet orifice from the external work surface.

According to another aspect of the fan for operating the method of the invention, the fan also includes a means for directing at least a portion of the air stream substantially perpendicularly to the work surface.

According to another aspect of the fan for operating the method of the invention, the fan also includes a means for rolling the confined space across the work surface.

Other aspects of the invention are detailed herein.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, which are not drawn to scale, wherein.

DETAILED DESCRIPTION OF PREFERRED EMBODIMENT

In the Figures, like numerals indicate like elements.

The present invention is a method and apparatus for drying a substantially planar work surface, the method using a fan for generating a pressurized air stream within a confined tubular space that is oriented substantially perpendicularly to the work surface, e.g., floor, and spaced away from the work surface for forming a substantially cylindrical opening between the confined space and the work surface. The air stream is directed along the confined space in a direction that is oriented substantially perpendicularly to the work surface. At least a peripheral portion of the air stream is exhausted from the confined space in a substantially laminar flow at an angle that is inclined relative to both the confined space in which the air stream is generated and the work surface. The peripheral portion of the laminar air stream is exhausted radially into ambient air from the cylindrical opening between the confined space and the work surface at an angle that is substantially perpendicular to the work surface.

The governing parameter for drying carpet using a portable electronic fan is air velocity and its distribution over the area to be dried as is shown by the following summary of the theory of mass transfer and evaporation. This theory is applied in testing, where airflow patterns generated by a portable electronic fan in standard parallel, commonly horizontal, orientation and non-standard perpendicular, commonly vertical, orientation are determined and compared.

Figure 1A:
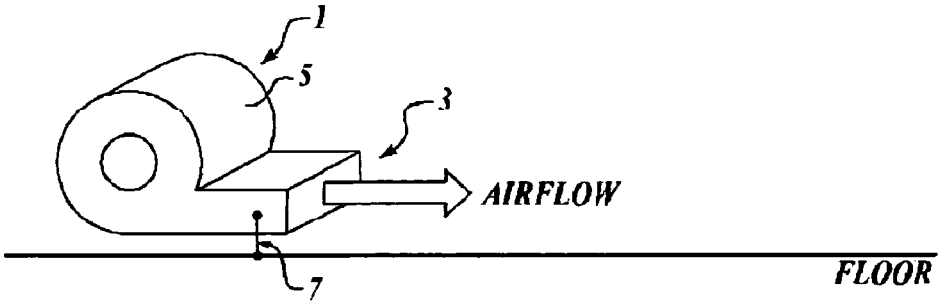
FIG. 1A (PRIOR ART)
FIG. 1A illustrates a fan of the well-known electrically driven, squirrel-cage blower of the type disclosed in U.S. Pat. No. 5,265,895.

For reference purposes FIG. 1A illustrates a fan of the well-known electrically driven, squirrel-cage blower type having a generally rectangular outlet or discharge chute 3, e.g., a blower of the type disclosed in U.S. Pat. No. 5,265,895, which is incorporated herein by reference, with the blower 1 oriented in the standard parallel or "horizontal" orientation.

Figure 2:
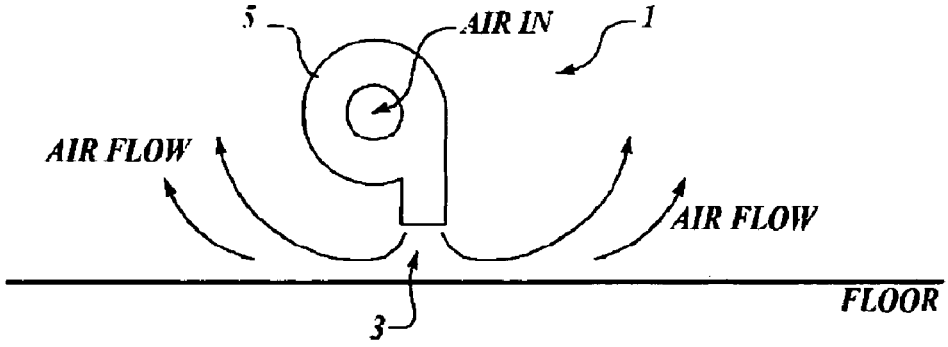
FIG. 2 illustrates the squirrel-cage blower of the type illustrated in FIG. 1A being oriented in a non-standard perpendicular or "vertical" orientation with the outlet or discharge chute directed toward the floor.

FIG. 2 illustrates the squirrel-cage type blower 1 oriented in the non-standard perpendicular or "vertical" orientation with the outlet or discharge chute 3 directed toward the floor.

FIG. 2 also qualitatively illustrates by arrows the flow direction of the blast of air generated by the fan upon impacting the floor as expected from generally accepted mechanical theory governing the air stream flow direction. As shown, the perpendicularly directed air stream is expected to impact the carpeted floor surface and reflect back generally perpendicular to the carpet surface in a turbulent flow.

Figure 3:
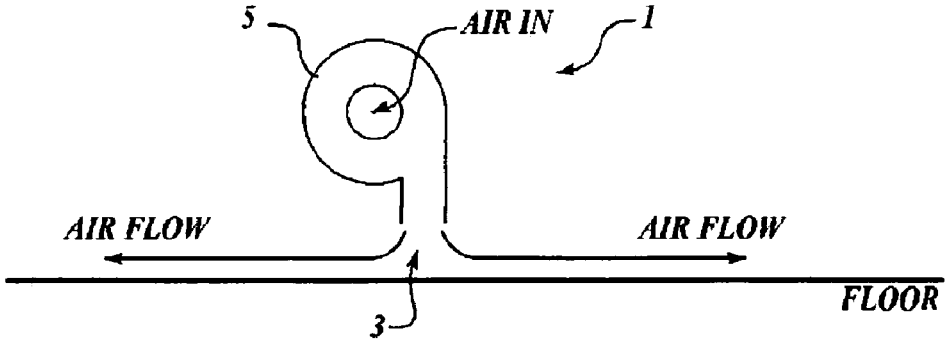
FIG. 3 qualitatively illustrates by arrows the actual measured flow direction upon impacting the floor of the blast of air generated by the squirrel-cage blower of the type illustrated in FIG. 1A being oriented as illustrated in FIG. 2.

FIG. 3 qualitatively illustrates by arrows the actual measured flow direction of the blast of air upon impacting the floor.

Briefly, in non-standard vertical orientation illustrated in FIG. 3 the blower 1 unexpectedly generates greater velocities at the floor-covering carpet than the same blower in the standard horizontal orientation, within a fixed generally rectangular area found to be approximately 8 feet by 4 feet. Fluid dynamic theory dictates that greater velocities at the floor-covering carpet result in a faster drying time within that fixed generally rectangular area. Experimental test results discussed herein and the inventor's anecdotal evidence both support this expected result.

Conversely, the standard horizontal orientation illustrated in FIG. 1A can generate some air velocity at greater distances from the blower 1 and is expected to generate greater velocities over greater total area than the same fan in the non-standard vertical orientation, because the less intense air stream generated in the standard horizontal orientation has lower fluid dynamic drag losses than the non-standard vertical orientation shown in FIG. 3.

Tests also show marginal changes in the intensity and distribution of the air stream generated by the blower 1 in the non-standard vertical orientation as height-above-carpet is varied. However, perpendicular air streams tend to cause spotting problems when used for drying upholstery, possibly due to perpendicular pressure tending to force the cleaning fluid downwards towards the upholstery backing directly underneath the jet whereupon the cleaning fluid moves outwardly carrying soap and soil picked up from the backing before evaporating to leave behind a ring of dried refuse.

Theory

Engineers refer to the rate of carpet drying by forced-air movement as a mass-transfer problem. According to generally accepted mechanical theory, mass transfer rates from a flat plate to an air stream moving across it are governed by:

$$M/A=(0.296)V^{0.8}[\mu/\nabla\nabla]^{0.2}(C_{SAT}-C_{AIR}); \quad \text{(Eq. 1)}$$

where M/A is the evaporation rate of water in mass per unit time per unit area, V is the velocity of the air stream, μ and ∇ are the viscosity and density of the air, respectively, ∇ is the distance along the plate from the leading edge, and $C_{SAT}$ and $C_{AIR}$ are the respective concentrations of water in the air at the carpet, which is a saturated condition, and in the free-stream air where the concentration of water in air is proportional to relative humidity. Thus, the evaporation rate is roughly proportional to the velocity of the air moving over the carpet. Evaporation rate is also affected by the relative humidity of the free air, and thus the temperature of the air. The equation is simplified by assuming that the plate is at a constant temperature; in reality the carpet will cool as the water evaporates, unless some heat is added to it from the air or other heat sources.

Since the fan cannot affect the humidity level in the room, nor add any appreciable heat, the only parameters the fan can affect are air velocity and distribution of air over the area to be dried.

Testing

Testing was conducted using a fan configured as a conventional 6-amp electrically driven, squirrel-cage blower of a type illustrated generically in FIG. 1A and by example in U.S. Pat. No. 5,265,895, which is well-known throughout the janitorial and carpet cleaning professions. The test blower was configured having an 18 inch by 4 inch outlet or "discharge chute" 3 located adjacent the bottom of the blower housing 5 and extending outwardly tangentially from the blower housing and parallel to the floor with the blast of air generated by the blower 1 being directed horizontally across the designated area of the floor, as illustrated in FIG. 1A.

Air velocities were measured using a slant-tube manometer measuring the differential between total (ram) air pressure and static room air pressure. The differential in manometer height is converted to velocity according to Bernoulli's equation:

$$V=[(2\nabla_w gh \sin \nabla)/\nabla_A]^{1/2}; \quad \text{(Eq. 2)}$$

where V is the velocity, $\nabla_w$ and $\nabla_A$ are the density of water or other fluid in the manometer and air, respectively, g is the acceleration due to gravity, h is the measured differential height of the manometer column along the tubes, and ∇ is the angle of the tubes relative to horizontal.

Figure 4:
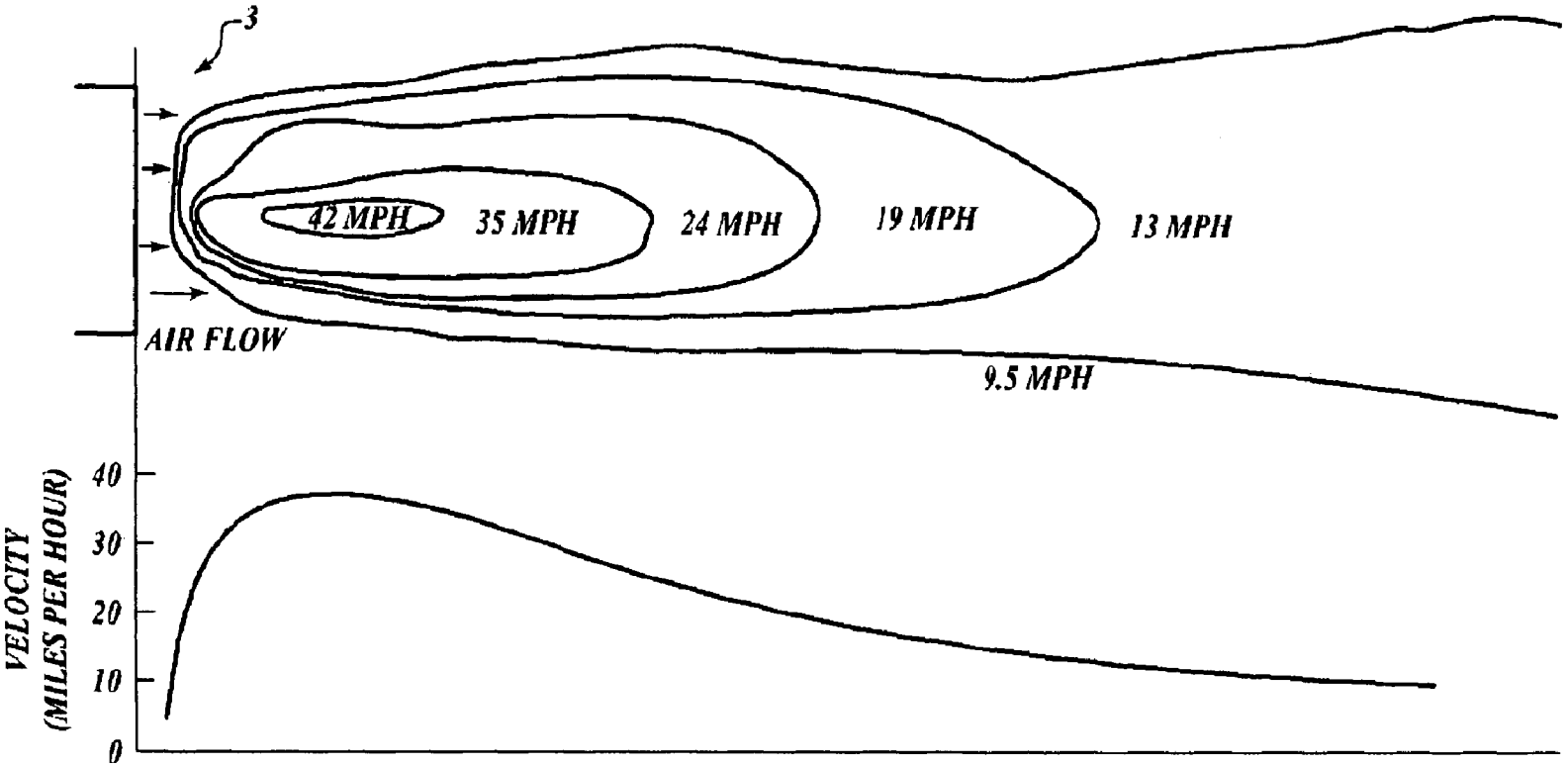
FIG. 4 reports measured air velocity distributions generated by the squirrel-cage blower of the type illustrated in FIG. 1A being oriented in a standard or "horizontal" orientation with the outlet or discharge chute directed parallel with the floor as illustrated in FIG. 1A.
Figure 5:
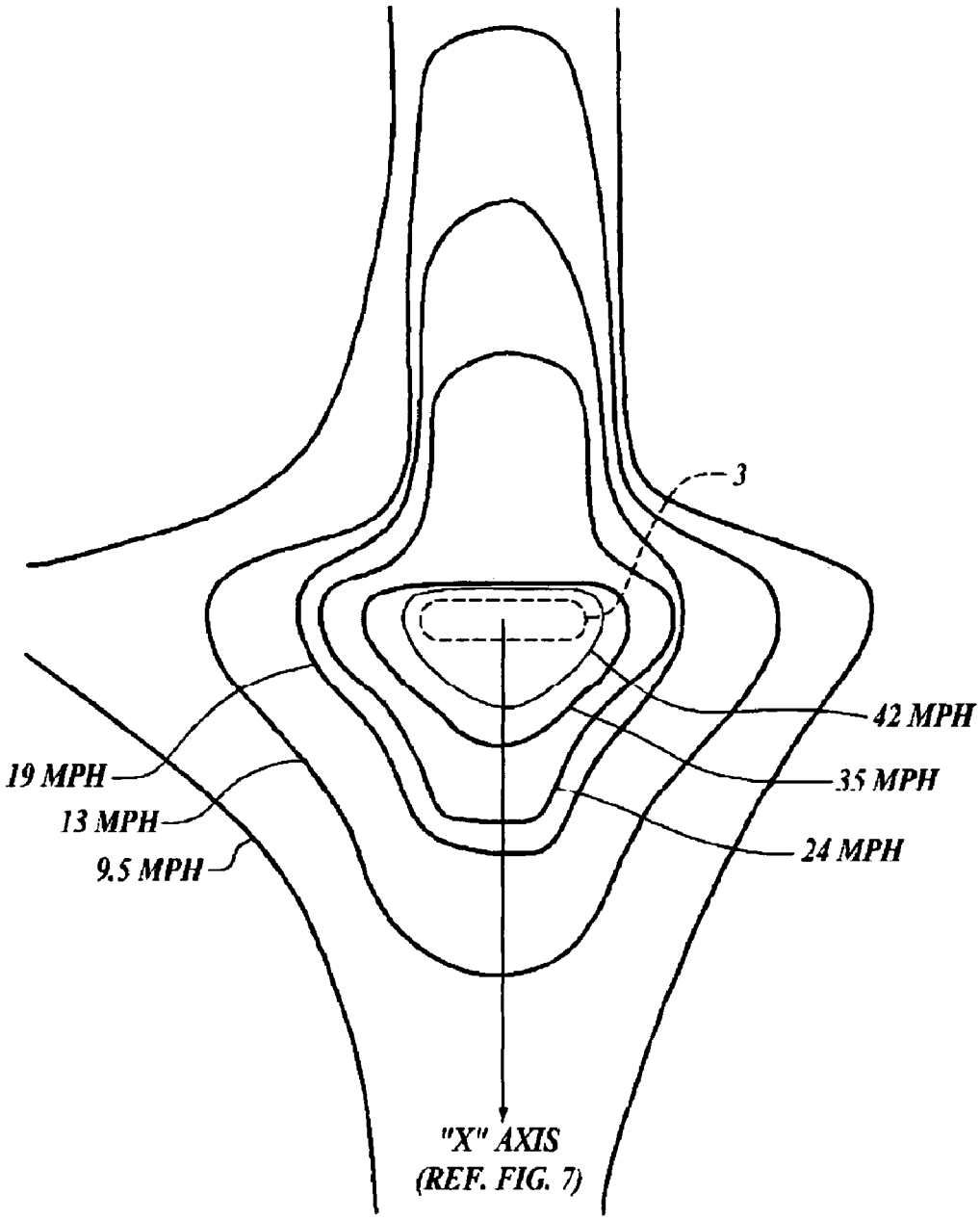
FIG. 5 reports measured air velocity distributions generated by the squirrel-cage blower of the type illustrated in FIG. 1A being oriented in a non-standard perpendicular or "vertical" orientation with the outlet or discharge chute directed toward the floor as illustrated in FIGS. 2 and 3.

FIGS. 4 and 5 present the measured velocity distributions, plotted as a "topographical map" from the blower 1 oriented horizontally and vertically, respectively, with the horizontal air velocities labeled in MPH (miles per hour). Air velocities were measured ⅜ inch above the carpet surface. In the vertical orientation, the outlet or discharge chute 3 was elevated 3½ inches above the carpet surface, and the blower 1 generated higher peak air velocities, and a wider area of higher air velocities, than in the horizontal orientation when measured at the same ⅜ inch above the carpet surface. As discussed above, the air velocity and distribution of air over the area to be dried are proportional to the fluid evaporation rate, or inversely the carpet drying time. Thus, given the air velocity and distribution generated in the different vertical and horizontal orientations, the interested party can quantify, e.g., in units of grams of water per hour per square foot or the equivalent, the difference in drying power of the two orientations.

Figure 6:
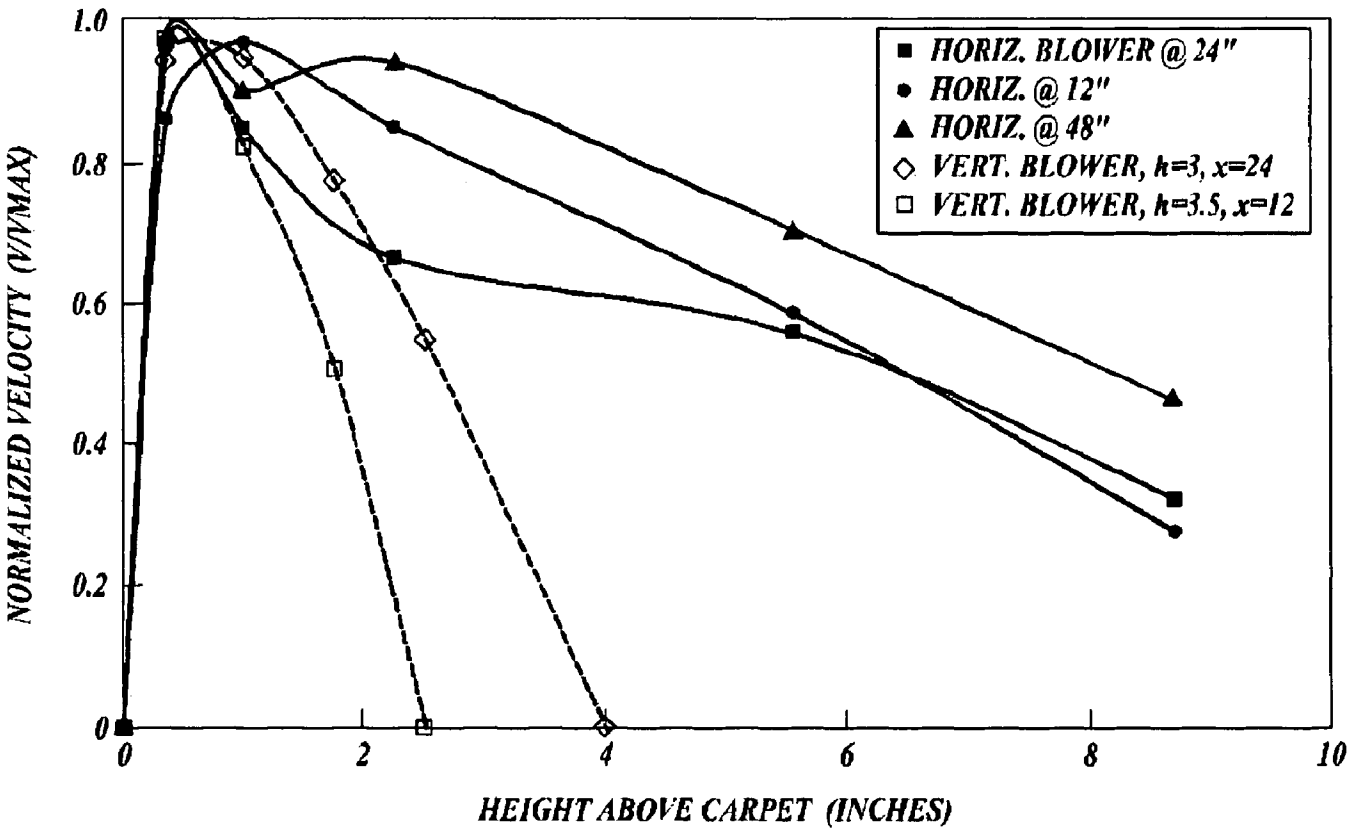
FIG. 6 reports and compares normalized vertical velocity distributions of the air jet generated by the blower illustrated in FIG. 1A oriented in the standard horizontal and non-standard vertical orientations.

FIG. 6 shows graphically why the vertical orientation can generate this more intense air distribution close to the carpet surface. In FIG. 6 the vertical air velocity distributions, i.e., velocity versus height-above-carpet, of the air jet generated by the blower 1 oriented in the standard horizontal and non-standard vertical orientations are plotted relative to each other. The velocities are normalized to: peak velocity=1.0, because the actual peak velocity varies greatly with position. In the non-standard vertical orientation the blower generated a jet of air which is more tightly "compacted" against the floor: within 2 to 4 inches, which is where the air is most effective for drying. Conversely, in the standard horizontal orientation the blower 1 distributed the velocity over a much greater (more than twice) volume of air above the carpet where it is useless for drying.

Figure 7:
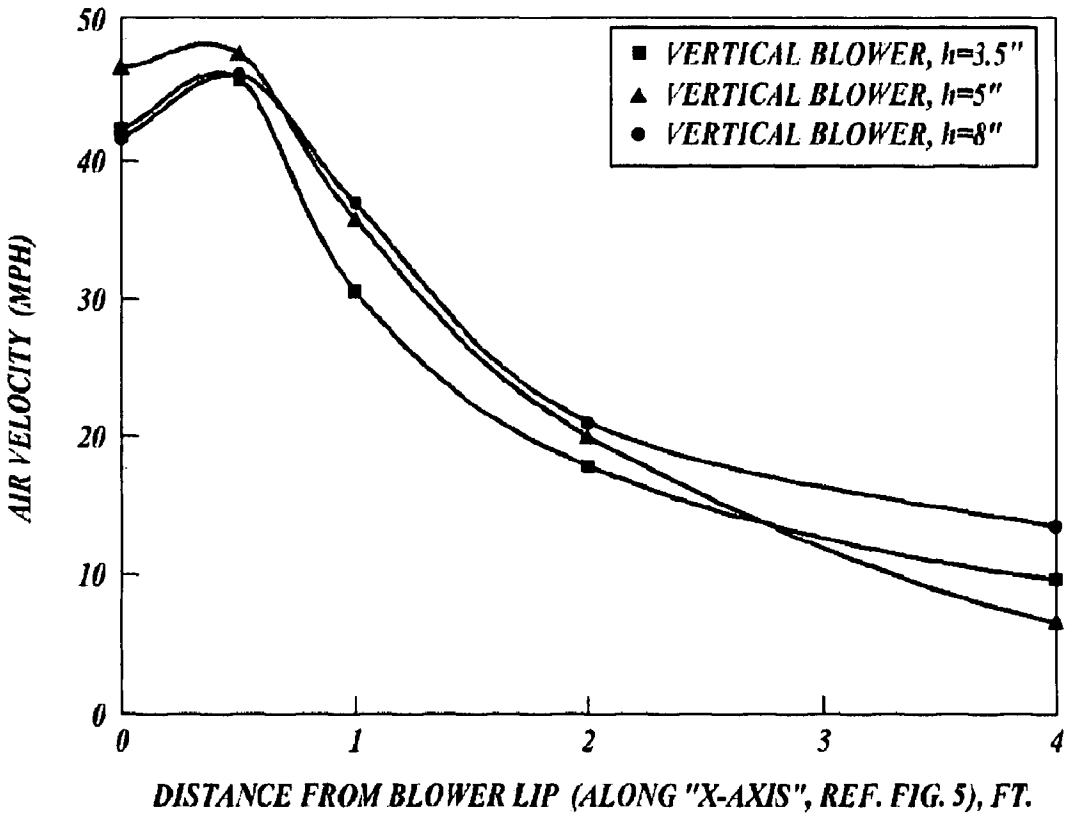
FIG. 7 reports air velocity profiles plotted for various blower offset heights for the blower illustrated in FIG. 1A oriented in the non-standard vertical orientation.

FIG. 7 shows that the air velocity profiles plotted for various blower heights above the carpeted floor for the blower 1 in the non-standard vertical orientation. The velocity profiles were measured along a line perpendicular to the blower outlet or "discharge chute," i.e. the X axis in FIG. 5. In general, the velocity profile improves, i.e., velocities are higher over more carpet area, as the vertically oriented blower height-above-carpet increases from 3.5 inches to 8 inches.

Perpendicularly-directed air streams were found to tend toward causing spotting and "drying ring" problems when used for drying upholstery. This spotting effect is believed to be due to the perpendicular air pressure tending to force the water or other cleaning fluid inwardly toward the upholstery backing directly before the jet. The water then moves outwardly along with whatever soil and cleaning solvent is removed from the backing. As the water evaporates it leaves behind a ring of dried soil and cleaning solvent.

Figure 1B:
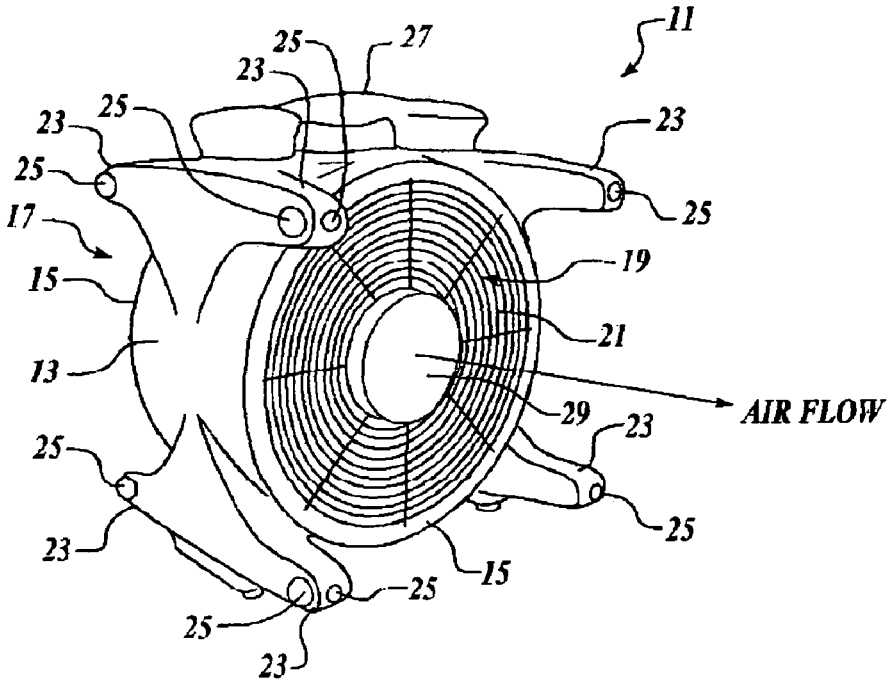
FIG. 1B (PRIOR ART)
FIG. 1B illustrates another well-known floor and carpet drying fan of the type disclosed in U.S. Design Pat. D480,467.
Figure 8:
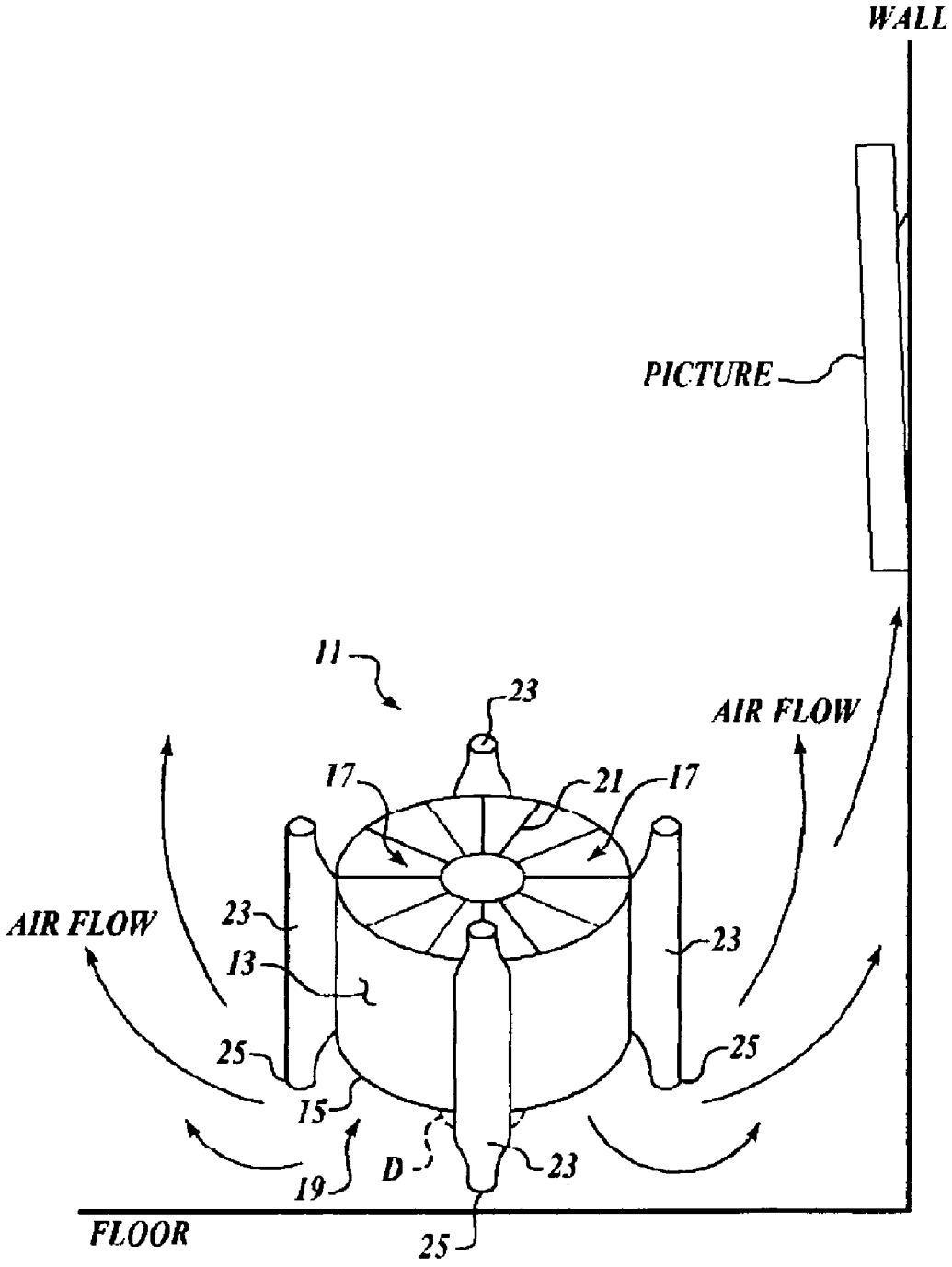
FIG. 8 (PRIOR ART)
FIG. 8 illustrates the air flow generated by the prior art fan structured according to prior art U.S. Design Pat. D480,467.

FIG. 8 illustrates the air flow generated by the prior art fan structured according to U.S. Design Pat. D480,467, which is incorporated herein by reference. FIG. 1B illustrates generically and FIG. 8 illustrate specifically the barrel-type fan 11 of the type illustrated by example in U.S. Design Pat. D480,467, which is well-known throughout the janitorial and carpet cleaning professions. As discussed above, well-known principles of generally accepted mechanical theory governing air stream flow indicate that the direction of the air stream generated by the perpendicularly or vertically oriented barrel-type fan 11 is expected to impact the carpeted floor surface and reflect back generally perpendicular to the floor in a turbulent flow. In fact, this turbulent reflection in the direction generally perpendicular to the floor is exactly what was exhibited by the known prior art fan 11 during experiments carried out by both the inventor and third parties: with the fan 11 in the perpendicular or vertical orientation illustrated in FIG. 8, the air stream impacted the carpeted floor surface and reflected back there from in a turbulent and confused mass, exactly as expected.

Furthermore, during experiments, the turbulent and incoherent air mass reflected from the floor surface maintained a high speed for several feet in the vertical direction. Anecdotally, the high speed air mass traveled vertically up nearby wall and furniture surfaces, ruffling and rotating pictures hanging on walls four to five feet above the floor and blowing loose papers around and off nearby desk surfaces. In confined spaces, e.g., hallways, the high speed air mass generated by the prior art fan 11 traveled along the length of the hallway and vertically up the end wall surface, but the high speed air mass also traveled vertically up the wall surfaces immediately adjacent to the fan's position in the hallway, causing pictures hanging on those hallway wall surfaces to be disturbed and pushed askew. For example, it is known and generally accepted among janitorial and carpet cleaning professionals that air speed is to be limited to a maximum of about 10 and ½ miles per hour in homes to keep air pressure from disturbing hanging pictures. Such disturbing behavior as that exhibited by the high speed air mass generated by the prior art squirrel-cage blower 1 of the type illustrated in FIG. 1A and disclosed in U.S. Pat. No. 5,265,895 forces the operator to account for objects, e.g., hanging pictures and loose papers, during operation of the prior art squirrel-cage blower 1. Such disturbing behavior thus keeps known squirrel-cage blowers from being useful in residential carpet and floor drying applications.

As applied to the known prior art barrel-type fan 11, the operator's need to avoid such disturbing behavior as that exhibited by high speed air masses is believed to cause the device to be limited in air volume throughput and generated air speeds in the output stream. For example, as described in the manufacturer's information, the known prior art barrel-type fan 11 illustrated in U.S. Design Pat. D480,467 is limited to a 1½ ampere, ¼ horse motor driving a single 16 inch diameter impeller. Accordingly, the known prior art barrel-type fan 11 is limited to a throughput of 2,000 cubic feet per minute (tested) at a static pressure of only 1.0 inch of water.

The known prior art barrel-type fan 11 is also known to exhibit a dead zone D in the zone directly beneath the impeller. This dead zone D has little or no air movement because the angular speed of the impeller blades is substantially zero. It is a generally well-known and understood physical phenomenon that the angular speed at or near the rotational axis must be at or near zero, else the blade tip which is spaced away from the rotational axis would approach infinite angular speed which is physically impossible. A result of this substantially zero angular speed of the impeller blades is that little or no high-speed air stream is generated at the center of the fan 11 and the dead zone D results. Furthermore, the air stream generated by the outer portions of the impeller blades fails to travel into the dead zone D because the air stream follows the path of least resistance which is outwardly under the lip 15 and into the relatively low pressure environment surrounding the fan. In fact, as shown in FIG. 1B, the known prior art barrel-type fan 11 illustrated in FIG. 8 and disclosed in U.S. Design Pat. D480,467 includes a large round plate or plug 29 at the center of the protective wire grille 21 covering the outlet orifice 19 dead center of the fan's impeller and directly above the dead zone D. The plate 29 actually guarantees that the dead zone D will occupy the floor area directly in front of the prior art fan 11.

In an ordinary use, such as for cooling a room by moving air, this dead zone D is of no consequence because the work surface against which the fan operates is typically sufficiently distant from fan that the air streams generated by the outer portions of the impeller blades have ample space in which to converge and combine in a manner that causes the dead zone D to fill-in at a distance away from the fan outlet 19. Because the work surface, i.e., the floor or carpet surface, is so close to the fan outlet 19 in the configuration illustrated in FIG. 8, the air streams generated by the outer portions of the impeller blades do not have enough space in which to converge and combine and the dead zone D is not filled with the high-speed air stream. Because the evaporation rate is roughly proportional to the velocity of the air moving over the floor or carpet, the floor or carpet area within the fan's dead zone D necessarily dries at a slower rate than those portions of the floor or carpet further from the rotational axis of the impeller at the center of the fan 11. Thus, the operator must either leave the fan 11 in place for a longer period to dry the floor or carpet in the dead zone D, or must pick up and move the fan 11 short distances more often than would otherwise be necessary.

Figure 9:
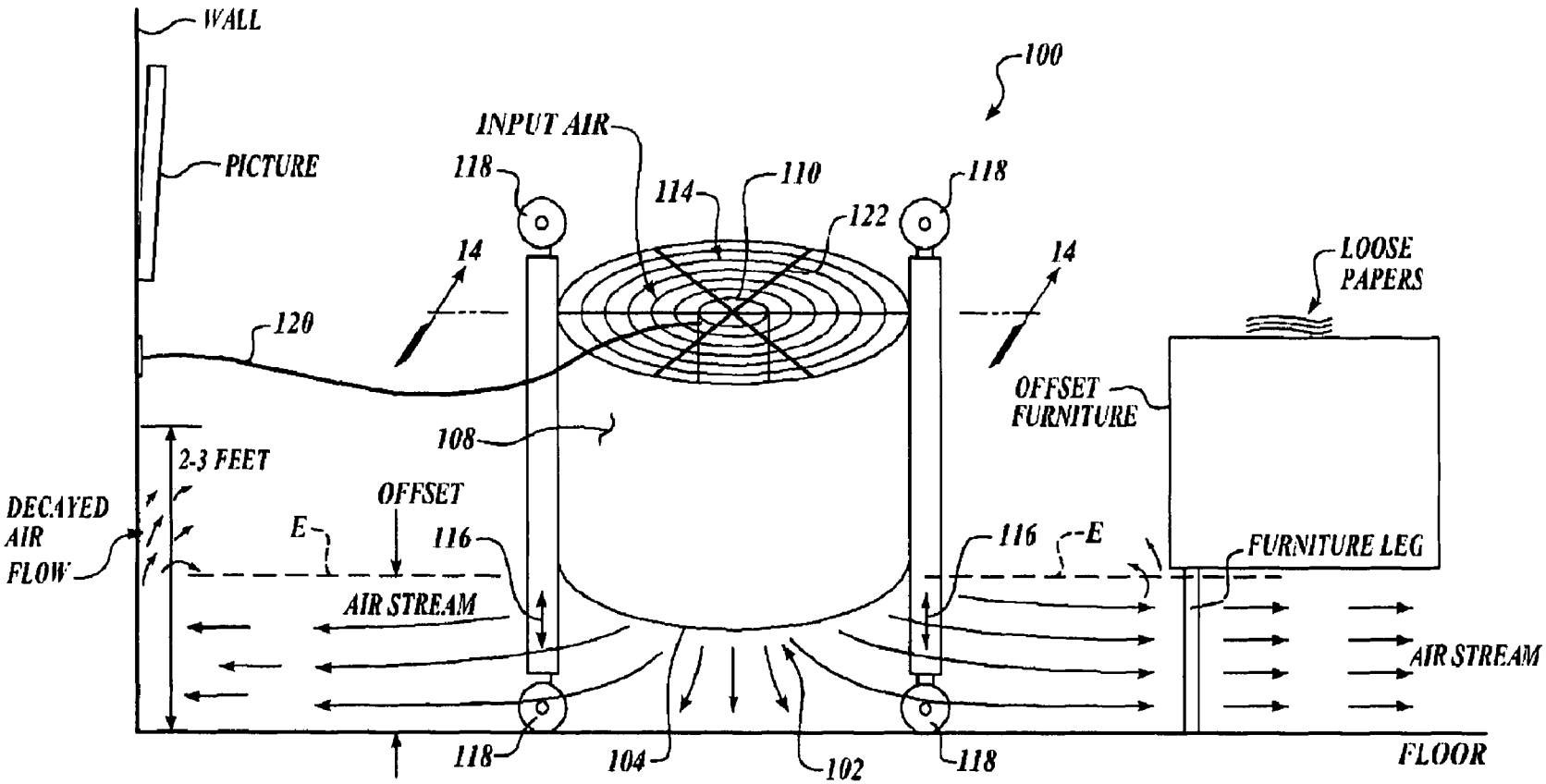
FIG. 9 illustrates the present invention that overcomes the limitations of the prior art.

FIG. 9 illustrates the present invention that overcomes the limitations of the prior art fan 11 by providing, by example and without limitation, a fan 100 configured for generating a substantially laminar stream of air that, after impacting a generally planar perpendicular work surface, e.g., floor, positioned a short distance away from the fan outlet orifice 102, is compacted against the floor or other perpendicular work surface and travels radially outwardly in all compass directions away from the outlet orifice 102 in a substantially laminar air stream. As indicated by the arrows, the air flow generated by the fan 100 and exhausted via the outlet orifice 102 travels in substantially laminar flow while remaining generally within a narrow envelope E adjacent to the floor surface for extended distances from the fan 100 along paths of least resistance, i.e., not blocked. Furthermore, as indicated by the smaller arrows adjacent the wall surface, the air flow decays quickly upon contact with right angle surfaces, e.g., the wall surface. The air stream generated by the fan 100 exhibits substantially laminar flow characteristics and remains generally within the envelope E for extended distances in all radial directions from the fan 100. The top surface of envelope E was found to be approximately even with the surface of a lower lip 104 of the fan outlet orifice 102. In other words, the envelope E within which the air stream remains is about the same dimension as the height of the fan outlet orifice 102 above the floor or carpet surface. Thus, for a fan 100 of the present invention having the fan outlet orifice 102 spaced in the range of two to five inches above the floor, the fan 100 generates a substantially laminar radial air stream that is substantially confined to an envelope E that is substantially contained in a zone between the floor and a corresponding upper limit of two to five inches above the floor.

Clearly, continuation of this substantially laminar air flow for a long distance from the outlet orifice 102 of the fan 100, containment of the air flow within a narrow space above the work surface, and rapid decay of the air stream upon meeting upright obstructions, e.g., wall surfaces, were all completely unexpected results as they were unpredictable based on generally accepted mechanical theory governing the flow direction of an air stream impacting a perpendicular surface, as discussed herein. Rather, generally accepted mechanical theory predicts that the air stream will, upon impact with a perpendicular surface, reflect back from the surface in a generally turbulent flow. Furthermore, the experiments performed on the prior art fan 11 support and confirm the outcome predicted by generally accepted mechanical theory. Therefore, the prior art provided no reasonable expectation that the above actual results would be achieved through the present invention.

Table 1 shows experimental results for the fan 100 of the present invention for air speed measured at different distances from the fan 100 and for different offset distances of the lower lip 104 of the fan outlet orifice 102 from the substantially planar work surface, i.e., the carpet or floor surface. The experimental results shown in Table 1 were achieved using a single 20 inch diameter impeller 106 (shown in FIG. 14) having six blades of a 35 pitch mounted on the drive shaft 107 of a 1,750 RPM, ½ horse 120 VAC electric motor 110. The single 20 inch diameter impeller 106 is suspended by the motor 110 inside a 21 inch substantially cylindrically tubular enclosure or shroud 108, so that the tips of the impeller 106 clear the shroud 108 by about a ½ inch. This minimal clearance maximizes the pressure generated by the fan while avoiding interference between the impeller 106 and the shroud 108. During the experiments that provided the results in Table 1, the motor 110 had a current draw of about 8.7 amperes.

Substantially the same experimental results were achieved with the fan 100 of the present invention for the same offset distances of the lower lip 104 of the fan outlet orifice 102 from the work surface or floor when operated using two 20 inch diameter 3-blade impellers 106 (shown in FIG. 14) mounted in tandem on the elongated drive shaft 107 of a 1,750 RPM, ½ horse 120 VAC electric motor 110. The two 20 inch diameter 3-blade impellers 106 are suspended by the motor 110 inside the 21 inch substantially cylindrical shroud 108, so that the tips of impellers 106 clear the shroud 108 by about a ½ inch which maximizes the pressure generated by the fan while avoiding interference between the impellers 106 and the shroud 108.

Furthermore, as can be seen from achieving substantially the same results using different quantities and combinations of fan impellers 106, the fan 100 of the present invention can be practiced in various different forms using different combinations of single and multiple fan impellers 106 with different motors 110 of different horse power, speed and current draw. The present invention can also be practiced using different heights for the shroud 108. For example, when practiced using multiple fan impellers 106, the extra length of the motor drive shaft 107 required for tandem mounting of the multiple impellers 106 causes the shroud 108 to be taller than when practiced with a single impeller 106 that permits the motor 110 to have a shorter drive shaft 107 of more conventional length.

It has also been demonstrated that increasing air movement through the fan 100 using different combinations of increasing numbers of impeller blades or the size, shape or pitch of the impeller blades, either on single or multiple impellers 106, driven by increasingly powerful motors 110, increases the distance from the fan outlet orifice 102 to which the substantially laminar air stream travels adjacent to the work surface within the envelope E at a speed that is still useful for drying the work surface.

Thus, the present invention contemplates different equivalent embodiments that accomplish the multiple intended purposes of generation of a radial air stream having substantially laminar air flow characteristics that continues for a long distance from the outlet orifice 102 of the fan 100, containment of the air stream within a narrow space above the work surface, and rapid decay of the air stream upon meeting upright obstructions, e.g., wall surfaces.

TABLE 1

| Height above work surface (Inches) | Distance from fan (Feet) | Air Volume (CFM) | Air Speed (MPH) | Water Pressure (Inches of Water) |
|---|---|---|---|---|
| 5" | 0' | 4580 | 26.43 | 0.45 |
| 5" | 1' | 3533 | 16 | 0.2 |
| 5" | 2' | 2430 | 15.3 | 0.15 |
| 5" | 3' | 1906 | 12.2 | 0.05 |
| 5" | 4' | 1819 | 9.9 | 0 |
| 5" | 5' | 1493 | 8.6 | 0 |
| 4" | 0' | 4952 | 30.2 | 0.45 |
| 4" | 1' | 3368 | 21.5 | 0.14 |
| 4" | 2' | 2645 | 16.1 | 0.1 |
| 4" | 3' | 2007 | 12.5 | 0.05 |
| 4" | 4' | 1708 | 10.7 | 0.05 |
| 4" | 5' | 1420 | 9.2 | 0.05 |
| 3" | 0' | 3847 | 31.8 | 0.7 |
| 3" | 1' | 2643 | 22.9 | 0.3 |
| 3" | 2' | 2073 | 18.5 | 0.15 |
| 3" | 3' | 1733 | 14.7 | 0.01 |
| 3" | 4' | 1403 | 12 | 0.05 |
| 3" | 5' | 1236 | 10.6 | 0.05 |
| 2" | 0' | 2484 | 32.8 | 1.1 |
| 2" | 1' | 1632 | 21.4 | 0.2 |
| 2" | 2' | 1455 | 17.2 | 0.15 |
| 2" | 3' | 1147 | 14.2 | 0.1 |
| 2" | 4' | 1001 | 12.1 | 0.05 |
| 2" | 5' | 816 | 10.1 | 0.05 |

Clearly, the present invention provides conditions that permitted use of either single or multiple impellers 106 of much larger diameter than was permitted by the prior art barrel-type fan 11, with the one or more impellers 106 being driven by a much larger and more powerful motor than was possible with the prior art device. Yet, as illustrated by the experimental results in Table 1, the present invention generates a substantially laminar air flow that remains substantially contained within the narrow envelope E of space above the work surface, which is much more effective for drying than the turbulent and incoherent air mass reflected upward from the floor surface by the prior art barrel-type fan 11 during similar experiments.

Figure 10:
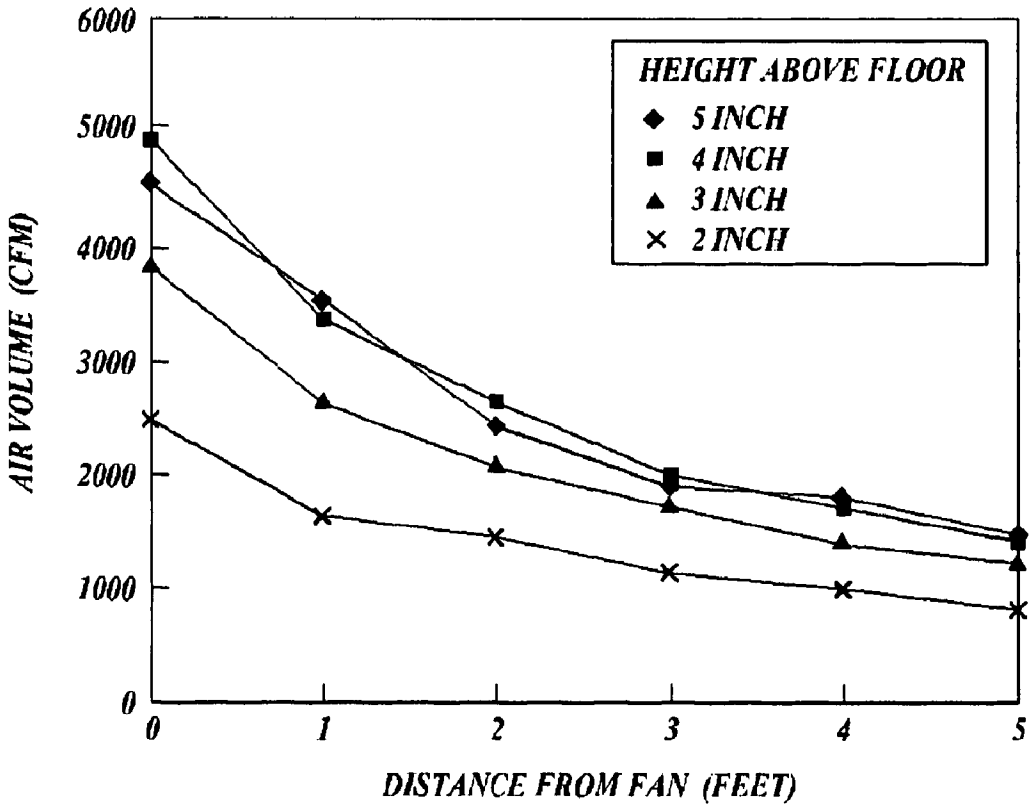
FIGS. 10, 11 and 12 report graphically the different results tabulated in Table 1.
Figure 11:
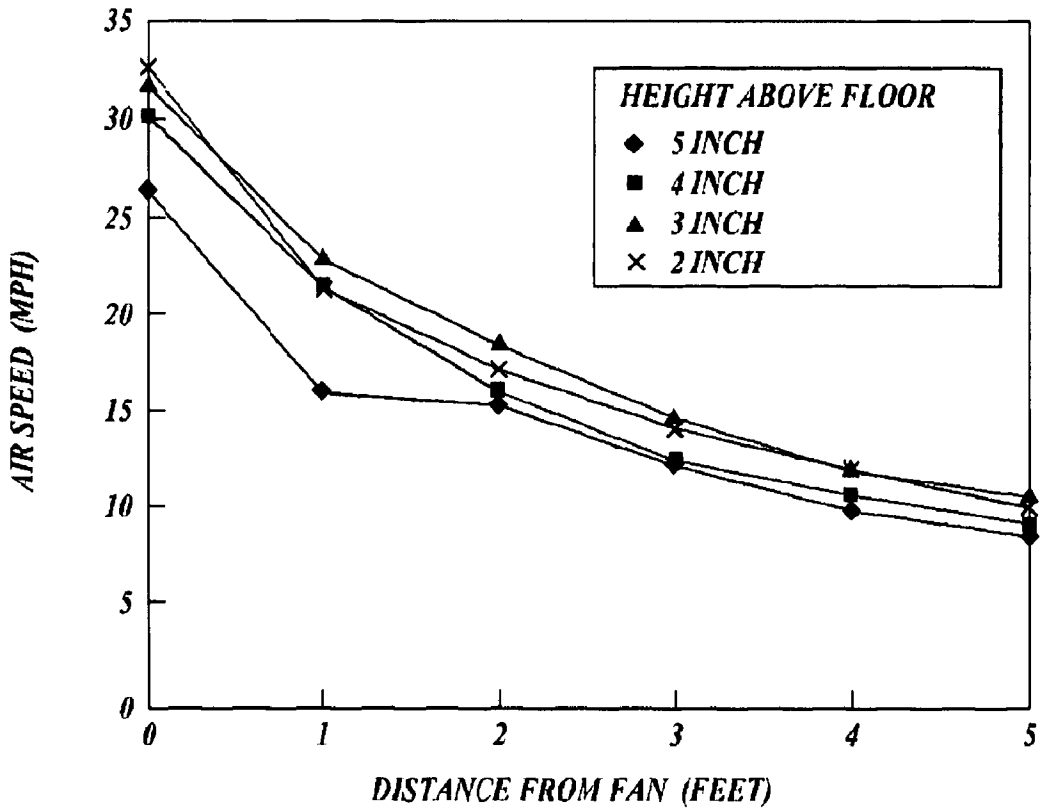
Figure 12:
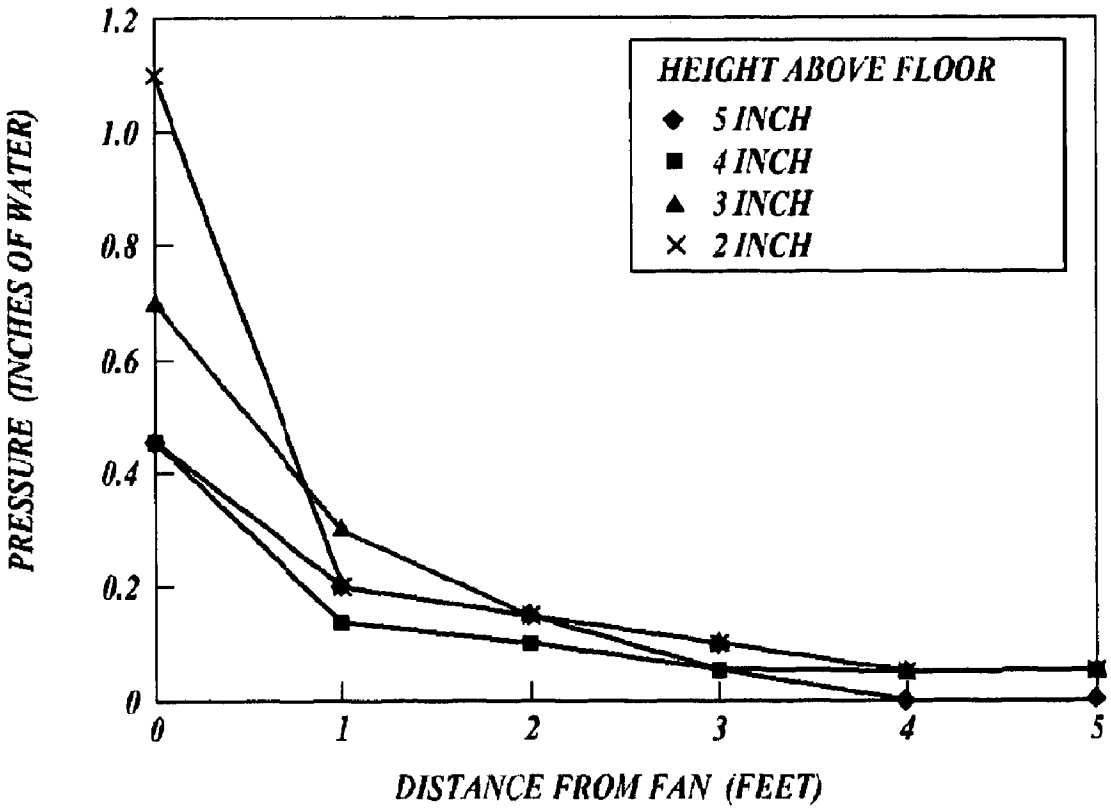

FIGS. 10, 11 and 12 report graphically the different results tabulated in Table 1. FIG. 10 reports air flow in cubic feet per minute (CFM) versus distance traveled from the center of the fan 100. FIG. 11 reports air speed in miles per hour (MPH) versus distance traveled from the center of the fan 100. FIG. 12 reports air pressure in inches of water versus distance traveled from the center of the fan 100.

Table 1 in combination with the graphs shown in FIGS. 10, 11 and 12 also illustrates that spacing the fan outlet orifice 102 in the range of about 3 to 4 inches is most effective for producing the air stream that is substantially laminar for a long distance from the outlet orifice 102 of the fan 100, is contained within the narrow envelope E above the work surface where the air is most effective for drying, and rapidly decays upon meeting upright obstructions. While a 2 inch offset spacing is still effective, FIG. 10 shows that the volume of the air stream is substantially less than an offset spacing in the range of about 3 to 4 inches, and FIG. 12 shows that the static pressure is less stable. Furthermore, while an offset spacing of 5 inches is also still effective, FIG. 11 shows that initial speed of the air stream at the outlet orifice 102 is diminished as compared to an offset spacing in the range of about 3 to 4 inches. Also, FIG. 12 shows that for an offset spacing of 5 inches the initial static pressure of the air stream at the outlet orifice 102 is significantly diminished and actually drops to near zero beyond about 3 feet from the fan 100, which significantly diminishes the overall efficiency of the device for drying floors. It can be projected that, because of the diminishing air speed and air pressure at increased offset spacings, further increases in the offset spacing of the fan outlet orifice 102 from the floor will only further diminish the fan's effectiveness for its intended purpose, i.e., floor and carpet drying, until the intended purpose cannot be accomplished at all. Therefore, the offset spacing range of 2 to 5 inches is significant for being the only range of offset spacings wherein the fan 102 can operate effectively to accomplish its intended purpose.

Figure 13:
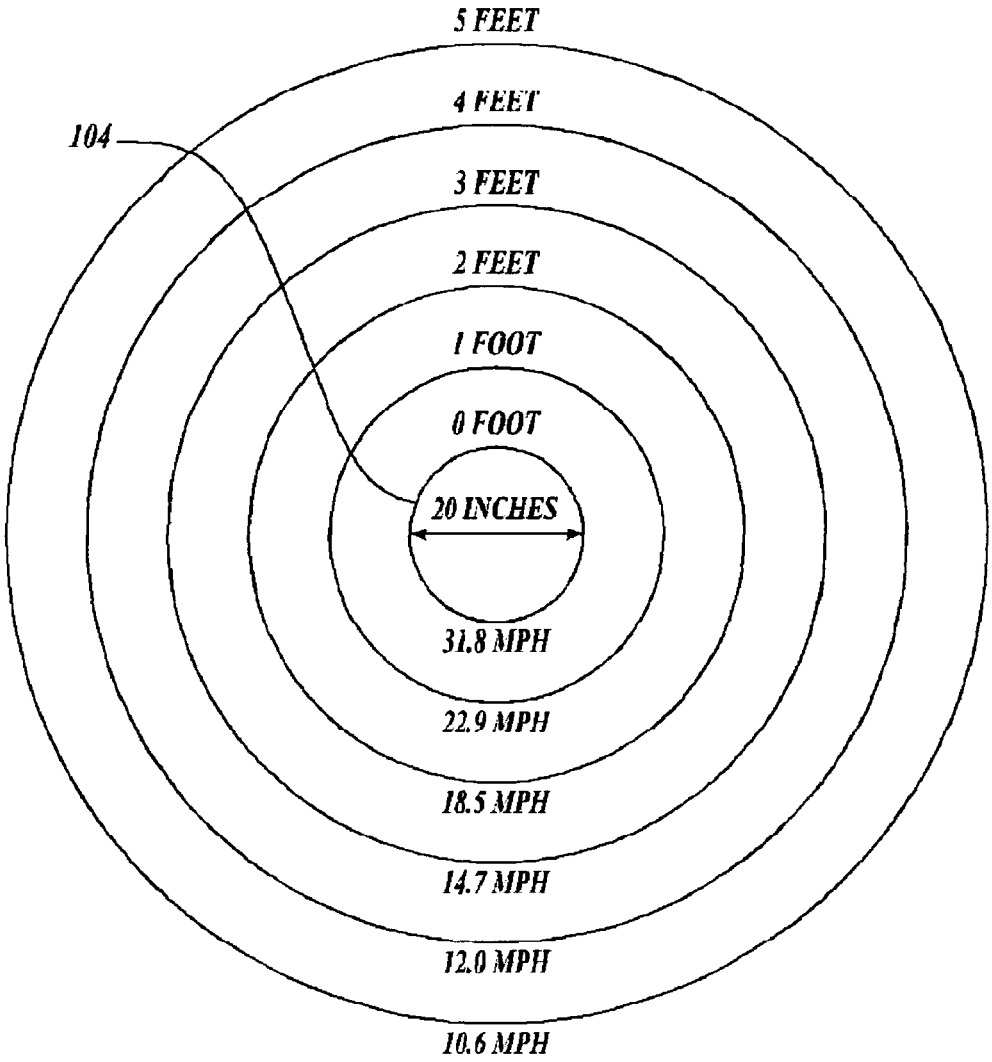
FIG. 13 is a topographical plot that illustrates the radial flow pattern of the air stream generated by the fan of the present invention as reported in Table 1 for the fan lip being spaced three inches off of the work surface.

FIG. 13 is a topographical plot showing the radial flow pattern of the air stream generated by the fan 100 of the present invention for the fan lip 104 being spaced 3 inches off of the work surface, i.e., the carpeted floor. Significantly, the notorious dead zone D generated directly beneath the prior art barrel-type fan 11 during similar experiments is eliminated by the fan 100 of the present invention. Rather, air volume, air speed and air pressure of the air stream in the zone directly beneath the center of the fan 100 within the zone covered by the fan lip 104 is substantially as effective for the intended purpose, i.e., drying the work surface within the zone covered by the fan lip 104, as the air stream in the radial zone outside the lip 104 and surrounding the fan 100.

As shown numerically in Table 1 and graphically in FIGS. 10, 11, 12 and 13, a spacing or offset of the fan lip 104 above the work surface to be dried in the range of 2 inches to 5 inches is effective for producing the completely unexpected and unpredictable yet desirable result of generating a substantially laminar air flow that continues to a distance of more than 5 to 6 feet from the outlet orifice 102 of the fan 100, or about a 6 foot radial area centered on the fan 100, is contained within a narrow space or envelope E above the work surface, and rapidly decays upon contact with upright obstructions, e.g., wall surfaces. According to one embodiment of the invention, the fan lip 104 is offset above the work surface a distance of 3 inches plus or minus ½ inch, i.e., 2½ to 3½ inches above the floor. In contrast, the known prior art barrel-type fan 11 is known to be constructed having the rounded lip 15 at the outlet orifice 19 spaced a measured distance of 5½ inches from the ends of the molded plastic legs 23. Because the prior art fan 11 does not provide for adjustment of the offset from the work surface, the outlet orifice 19 is necessarily offset a fixed distance of 5½ inches from the work surface. As projected by the experimental evidence reported in Table 1, the fixed offset distance of 5½ inches will diminish the air speed and air pressure, both initially as the air stream is exhausted from the fan and at a distance from the fan, as to significantly diminishes the overall efficiency of the device to the extent that it will not efficiently accomplish its intended purpose, i.e., drying floors.

The experimental evidence also indicates that an object spaced above the bulk of the envelope E containing the air stream does not impede the flow of the air stream. Although not shown in Table 1, experimental evidence indicates that the air stream travels under furniture having adequate space beneath, e.g., furniture with legs that offset the bulk of the object 2 or more inches above the floor. In other words, furniture offset from the floor on legs does not generally constitute an obstruction to the air flow within the envelope E if the bulk of the object is offset above the bulk of the envelope E containing the air stream. Rather, the air stream travels unimpeded around the furniture legs and under the bulk of the object. Therefore, loose papers for example on a desk are not disturbed because the air stream travels under the desk rather than up the desk's upright or vertical surfaces. Furthermore, experiments determined that the air stream decays rapidly upon contact with such upright surfaces, the air speed dropping as low as 2 to 3 miles per hour at heights of 2 to 3 feet from the floor. Thus, the air speed is sufficiently low at typical desk, table and counter heights as not to disturb loose papers and other light materials on the working surfaces of such objects, even when the object does not have space beneath for the air stream to travel through unimpeded.

Figure 14:
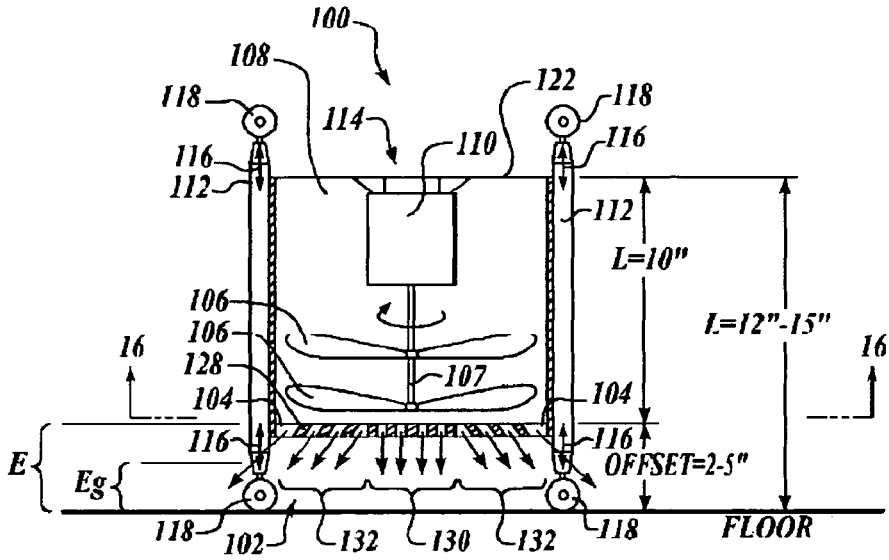
FIG. 14 is a cross-sectional side view that illustrates the fan of the present invention taken through the view illustrated in FIG. 9.
Figure 15:
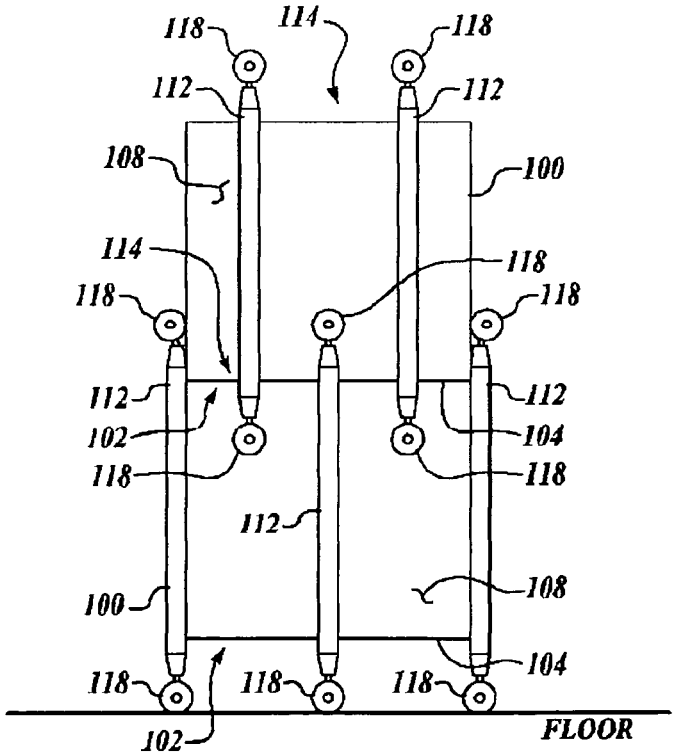
FIG. 15 illustrates that a second fan of the present invention can be stacked on a first fan with their respective shrouds aligned along their respective longitudinal axes.

FIG. 14 illustrates the fan 100 of the present invention embodied, by example and without limitation, as the tubular shroud 108 having an inside cylindrical diameter of about 21 inches, as discussed herein, for accommodating the one, two or more 20 inch impellers 106. According to one embodiment of the present invention, the tubular shroud 108 has a length L of about 10 inches, and the lower lip 104 of the fan outlet orifice 102 is offset from the floor or other work surface by 3 or 4 legs 112 substantially uniformly distributed around the outer peripheral shroud surface. According to different embodiments of the present invention, the legs 112 are of fixed length and uniformly space the fan output orifice 102 a fixed distance of two to five inches from the floor or other work surface. Accordingly, the fan 100 has a fixed overall height H of 12 to 15 inches. As illustrated in FIG. 15, a second fan 100 can be stacked on a first fan 100 with their respective shrouds 108 aligned along their respective longitudinal axes because the legs 112 are external to the shroud 108. The legs 112 of the second fan 100 are angularly inclined relative to the legs 112 of the first fan 100 so the legs 112 of one fan 100 do not interfere with the legs 112 of the other fan 100. Accordingly, the fans 100 of the invention are thus stackable with the outlet orifice 102 of the upper fan 100 abutted with an inlet orifice 114 of the lower fan 100, either for adding together the air stream generating power of two or more fans 100, or merely for transportation or storage.

According to one embodiment of the present invention, the offset distance of the lower lip 104 of the fan outlet orifice 102 from the work surface is adjustable by means of the legs 112 being lengthwise adjustable, as indicated by arrows 116, either incrementally as by pins or detents in apertures between different telescoping leg sections, or infinitely by twist-type clamping between different telescoping leg sections, or by yet another suitable mechanical means for substantially permanently adjusting the length of each leg 112 to change the offset distance between about 2 inches and 5 inches. Thus, according to one embodiment, the fan overall height H is adjustable in the range of about 12 inches to 15 inches. Such adjustable length telescoping legs 112 are shown for example on the adjacent to the air inlet orifice 114 located at the opposite end of the shroud 108 from the outlet orifice 102. According to one embodiment of the invention, legs 112 include a threaded end portion that extends and contracts the length of the individual legs 112 by threading into a portion of the respective leg 112 that is fixed to the fan shroud 108. Accordingly, the fan 100 is adjustable to accommodate different work surfaces having different characteristics. For example, when the work surface is a smooth surface, e.g., tile or wood, the offset may be adjusted to a first distance that is more or less than a second offset distance that is more effective for drying a deep pile carpet.

According to another embodiment of the invention, the legs 112 extend beyond the fan shroud 108 both at the outlet orifice 102 and the opposite air inlet orifice 114. According to one embodiment of the invention, at least the legs 112 adjacent to the outlet orifice 102 include wheels or casters 118 on their ends distal from the shroud 108 for moving the fan 100 by rolling. When the casters 118 are omni directional, i.e., rotatable around an axis parallel with the longitudinal axis of the leg 112, the casters 118 permit the fan 100 to be rolled across the work surface in any direction, as by merely pulling on an electrical cord 120 connecting the motor 110 to an electrical power source, e.g., a wall outlet. Alternatively, the operator can just as easily move the fan 100 by pushing against the shroud 108 which is tough enough to be moved as well by kicking. According to one embodiment of the present invention, the casters 118 are about 2 inch diameter omnidirectional casters that maximize mobility of the fan 100 and simultaneously minimize interference with the air flow from the outlet orifice 102.

The fan motor 110 is optionally secured to the fan shroud 108 through the intermediary of a conventional protective wire grille 122 to which the fan motor 110 is mechanically coupled by conventional means such as multiple bolts or screws.

Figure 16:
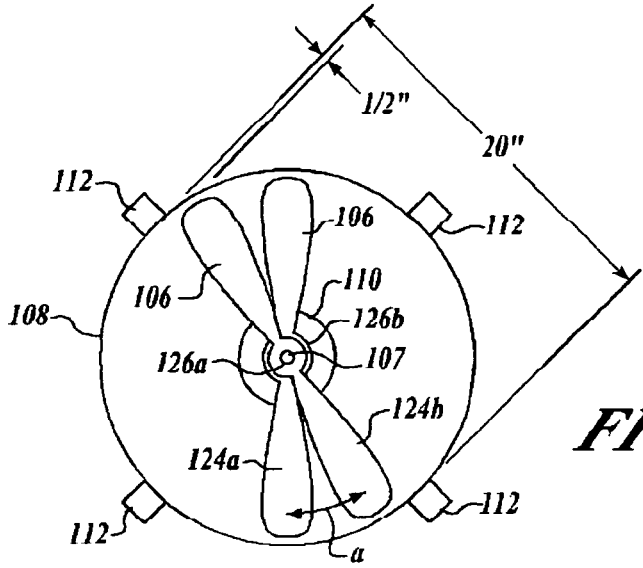
FIG. 16 illustrates the fan of the present invention being fitted with multiple fan impellers, each angularly offset relative to the others.

According to one embodiment of the present invention, the fan motor 110 is sufficiently powerful, e.g., ½ horsepower, to drive one, two or more impellers 106 supported in tandem on the single elongated drive shaft 107. The volume of air (in cubic feet per minute), and static pressure (in inches of water) of the air flow at the outlet orifice 102 are both thereby increased substantially over a single impeller 106. Although not required, the blades 124*a* and 124*b* of the respective first and second impellers 106 may be angularly offset on the drive shaft 107 by an angle a, as illustrated in FIG. 16, by rotating their respective impeller hubs 126*a* and 126*b* by which the blades 124*a* and 124*b* are coupled to the drive shaft 107. The angle a may be any angle between 0 and 90 degrees for the two blade impellers 106 illustrated. The two impellers 106 are independent impellers that are independently coupled to the motor drive shaft 107 by their respective impeller hubs 126*a*, 126*b* such that the angle a between them can be changed at will by merely loosing the connection securing one impeller hub 126*a* or 126*b* to the drive shaft 107 and rotating the respective impeller 106 relative to the other, then tightening the loosened connection. The pitch of the impellers 106 is expected to be variable. According to one embodiment of the invention, the impeller pitch is variable between about 25 degrees and 30 degrees. However, each of the two or more impellers 106 is expected to have the same pitch. The impellers 106 are expected to be offset by an angle a on the order of 0 to 15 degrees for generating a maximum air volume and static pressure at the outlet orifice 102. For impellers 106 having three blades, the angle a is between 0 and 60 degrees, and for impellers 106 having four blades, the angle a is between 0 and 45 degrees. FIG. 16 also shows the spacing between the tips of the impeller blades 124*a*, 124*b* and the inner wall of the shroud 108.

The double impellers 106 are also effective for increase the degree of laminar flow imparted to the air stream generated by the fan 100. The increased laminar flow increases the degree to which the air stream is contained within the envelope E above the work surface. The increased laminar flow also increases the distance from the fan outlet orifice 102 that the air stream travels. Accordingly, the air stream is still traveling at a rate on the order of 8½ MPH to more than 10½ MPH at about 6 feet from the fan 100 of the present invention, as shown in the experimental results reported in Table 1, which is very effective for drying the work surface.

The fan 100 of the present invention has also been shown experimentally to drive the substantially laminar air stream generated thereby along a narrow corridor or hallway at the same 8½ MPH to more than 10½ MPH for at least the same radial distance of about 6 feet or more from the fan 100 location. The air stream generated in the hall has been shown experimentally to remain substantially within the envelope E for the length of the hallway, and furthermore to decay quickly upon contact with right angle surfaces, e.g., the hallway wall surfaces. The air stream generated in the hall has been shown experimentally to dissipate in one corner of the end of the hallway, whether the air stream dissipates in the left or right corner of the hallway end has been show experimentally to be a function of the fan drive direction.

According to one embodiment of the invention, the fan 100 includes a louvered fan grille 128 affixed to the lip 104 and is round to cover substantially the entirety of the substantially circular fan outlet orifice 102, the grille 128 being structured with conventional means for being coupled to the fan shroud 108. By example and without limitation, the grille 128 is affixed to the fan shroud 108 by multiple bolts or screws through a plurality of tabs 129 extended from the top surface of the grille 128. As illustrated in FIG. 14, the louvered fan grille 128 is configured with both a vertical cylindrically tubular center baffle 130 for driving air into the normally "dead" space, i.e., zone D of the prior art fan 11, directly down stream of, i.e., below, the fan 100 at the center of the impellers 106, and an outer inclined louvered baffle 132 that surrounds the vertical center baffle 130 for driving air radially outward in all directions in the thin envelope E that remains near the floor or other work surface for extended distances from the fan outlet orifice 102 and decays quickly upon contact with right angle obstacles, e.g., wall surfaces. According to one embodiment of the invention, the outer inclined louvered baffle portion 132 of the grille 128 is angled outwardly at an inclination angle of about 45 degrees.

Figure 17:
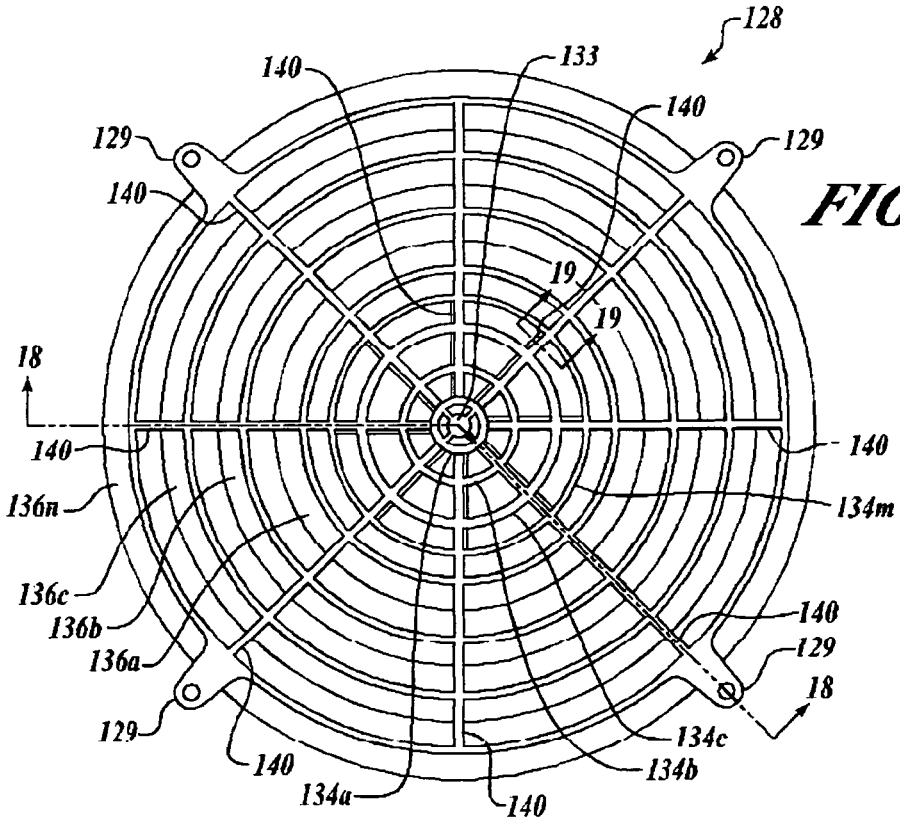
FIG. 17 is a detailed plan view of the louvered fan grille of the present invention for directing a portion of an air stream generated by the fan of the present invention into the "dead zone" exhibited by prior art fans, and simultaneously deflecting another portion of the air stream in a laminar flow perpendicular to the nominal direction of the air stream.
Figure 18:
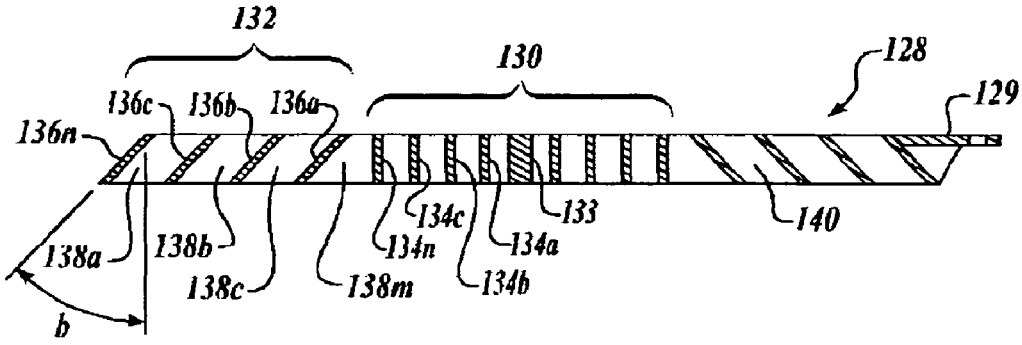
FIG. 18 is a cross-section view taken through the louvered fan grille of FIG. 17.

FIG. 17 is a detailed plan view of the louvered fan grille 128. FIG. 18 is a cross-section view taken through the louvered fan grille 128 of FIG. 17. A round plate or plug 133 is optionally provided at the center of the vertical center baffle 130 of grille 128. The center baffle 130 is formed of multiple inner concentric vertically tubular louvers 134*a*, 13*b*, 134*c* through 134*m*, and the outer inclined louvered baffle 132 of grille 128 that surrounds the vertical tubular center baffle 130 is formed of multiple outer concentric angularly inclined louvers 136*a*, 136*b*, 136*c* through 136*n*, where m and n are selected as a function of the size of the grille 128, the design of the impeller blades 124*a*, 124*b*, the angular speed in revolutions per minute (RPM) of the impeller, and other considerations, and are generally determined empirically, unless the designer has access to appropriate finite element analysis capabilities. The selected number of inner vertical tubular and outer angularly inclined grille louvers 134*m* and 136*n* may be the same, as shown, or may be different. Generally, the inner tubular louvers 134*a* through 134*m* of the vertical center baffle 130 of grille 128 encompass a sufficiently large diameter to cooperate with an effective portion of the impeller blades 124*a*, 124*b* having an angular speed substantially greater than zero that is effective for generating an air stream that is effective for drying the floor, carpet or other work surface. By example and without limitation, the inventor has determined that a quantity of six inner vertical tubular louvers 134*a* through 134*m*, where m=6, and the inner vertical tubular louvers 134*a* through 134*m* are uniformly radially spaced apart about 9/16 inch center-to-center between a first or innermost inner tubular louver 134*a* of 4¾ inches diameter and a last or outermost inner tubular louver 134*m* of 11¼ inches diameter causes the vertical center baffle 130 to be effective for generating air streams of the type illustrated in Table 1 when operated with the fan 100 of the present invention illustrated in FIG. 9 and described herein. A grille 128 wherein one or more of the parameters of the vertical tubular center baffle 130: quantity of inner vertical tubular louvers 134*a* through 134*m*, diameter for the innermost tubular louver 134*a*, diameter for the outermost tubular louver 134*m*, spacing between the innermost and outermost tubular louvers 134*a* and 134*m*, are different from the parameters described herein may also be effective for generating air streams of the type illustrated in Table 1 when operated with the fan 100 of the present invention or another fan encompassed by the description and drawings disclosed herein; such grille 128 having such one or more different parameters for the vertical tubular center baffle 130 is believed to be equivalent to the grille 128 described herein.

While the tubular louvers 134*a* through 134*m* are illustrated herein as being substantially parallel, they are optionally slightly inclined each tubular louver 134*a* relative to the next adjacent tubular louver 136*b* such that the inclination from vertical increases gradually outwardly between the innermost tubular louver 134*a* to the outermost tubular louver 134*m*.

The outer concentric inclined louvers 136*a* through 136*n* of the outer louvered baffle 132 are angularly inclined to an angle of about 45 degrees. This angular rotation of the outer concentric inclined louvers 136*a* through 136*n* operates to deflect the air stream generated by the fan 110 away from the floor or other work surface directly below the fan 110 and direct it under the lip 104 and into the envelope E, rather than permitting the air stream to drive directly into the work surface at a right angle. In contrast to the louvered fan grille 128 of the present invention, the prior art fan 11 as known and described in U.S. Design Pat. D480,467 covers the fan outlet orifice 19 with a simple protective wire grille 21 that is formed of simple round wire. Such a round wire grille is incapable of imparting any laminar flow character to the air stream passing through it and can only disrupt such air stream. The turbulent air streams generated by the prior art fan 11 using the simple protective wire grille 21 are inherently unstable and therefore inherently dissipate quickly upon release into ambient, i.e., unpressurized, air space surrounding the fan 11.

In contrast, the outer inclined louvered baffle 132 portion of the grille 128 of the present invention initially avoids imparting turbulent characteristics by deflecting the air stream away from the solid work surface directly opposite from the fan outlet orifice 102, and then imparts a laminar flow character to the air stream by smoothing the air stream through several substantially parallel inclined grooves 138*a*, 138*b*, 138*c* through 138*m* formed between the substantially parallel opposing walls of the substantially parallel outer concentric angularly inclined louvers 136*a* through 136*n*. As is dictated by generally accepted mechanical theory and is generally well-known and understood by those of ordinary skill in the art of fluid dynamics, flowing the air stream through such substantially parallel inclined grooves 138*a* through 138*m* inherently imparts a laminar flow character to the air stream. Thus, in contrast to the simple round wire grille 21 covering the outlet orifice 19 of the prior art fan 11, the outer louvered baffle 132 portion of the grille 128 of the present invention imparts laminar flow characteristics to the air stream as it exits the fan outlet orifice 102.

By deflecting the air stream outwardly of the fan 100 and thus away from the solid work surface directly opposite from the fan outlet orifice 102, the outer inclined louvered baffle 132 of the grille 128 causes the air stream to avoid taking on the turbulent air flow characteristics exhibited by air streams generated by the prior art fan 11. Instead of causing the air stream to take on such turbulent air flow characteristics, the outer inclined louvered baffle 132 of the grille 128 actually causes the air stream to take on laminar air flow characteristics that, in turn, cause the air stream both the remain close to the floor or other work surface within the envelope E, and also to flow further with more velocity than an air stream generated by the prior art fan 11. As is generally well-known, laminar air streams of the type produced by the fan 100 of the present invention through the grille 128 are more coherent than turbulent air streams, and such laminar air streams tend to retain their coherent character. Such coherency causes the laminar air stream produced by the fan 100 of the present invention through the grille 128 tends to travel in straight lines and therefore remain within the physical limits originally imparted, which is the space between the lip 104 of the fan outlet orifice 102 and the floor or other work surface. In essence, the air stream is extruded between the shroud lip 104 and the floor under pressure imparted by the fan impellers 106. Coherency in the air stream causes the air to thereafter maintain the flow lines thus initially imparted. Since the flow lines initially imparted to the air stream are along the floor radially from the fan shroud 108, the air stream naturally flows along the floor within the envelope E that extends radially from the lip 104 of the fan shroud 108. Because the air stream is a substantially coherent wave, it travels in a substantially straight line; and because the air stream travels straight, it maintains its speed and travels farther than a turbulent air stream of similar initial speed.

Furthermore, when used in combination with the fan 100 of the present invention, the air stream bending and smoothing features of the louvered grille 128 cooperate with the fan outlet orifice offset distance of 2 to 5 inches to further smooth the already substantially laminar air stream into an even more laminar air stream. The louvered grille 128 additionally drives the air stream into an envelope Eg that is contained even closer to the floor or other work surface than just the outlet orifice offset distance alone, and thereby makes the air stream more effective for drying by brining the air into closer proximity with the work surface.

The air stream slows as it encounters the ambient air surrounding the fan 100, but remains substantially coherent until it encounters an immovable obstacle, such as a wall. Upon encountering such an immovable obstacle, the air stream crashes into the object much like a wave crashing into rocks on a shore: the air stream experiences turbulence and becomes confused, losing its coherency, whereupon the air stream becomes turbulent and quickly dissipates into the surrounding ambient air. As discussed herein, the air stream thus decays rapidly upon contact with walls, rather than traveling up the wall.

Generally, the multiple outer concentric angularly inclined louvers 136*a* through 136*n* of the outer louvered baffle 132 of grille 128 cooperate with the tubular center baffle 130 to cover the outer portion of the impeller blades 124*a*, 124*b* not covered by the tubular center baffle 130. Generally, the outer concentric angularly inclined louvers 136*a* through 136*n* extend between the tubular center baffle 130 and the fan lip 104 of the shroud 108. The tubular center baffle 130 and the outer inclined louvered baffle 132 of grille 128 thus cooperate to cover substantially the entirety of the fan outlet orifice 102. As discussed herein the multiple outer concentric angularly inclined louvers 136*a* through 136*n* operate to deflect the air stream outwardly of the fan 100 and thus away from the area of the work surface directly opposite from the fan outlet orifice 102.

The number of multiple outer concentric angularly inclined louvers 136*a* through 136*n* determines the degree of laminar character imparted to the air stream. Generally, more of the louvered outer concentric inclined louvers 136*a* through 136*n* more effectively impart the desired laminar flow character to the air stream. However, in practice, the sum of area occupied by the end surfaces of the inclined louvers 136*a* through 136*n* is limited both so that the loss of area does not materially impact throughput of air, and so that the additional obstructions do not materially impact the flow characteristics of the air stream. According to one embodiment of the invention operated with the fan 100 of the present invention illustrated in FIG. 9 and described herein a quantity of 6 of the louvered outer concentric inclined louvers 136*a* through 136*n*, where n=6, are uniformly radially spaced apart about ⅝ inch center-to-center between a first or innermost inclined louver 136*a* of 13 inches diameter and a last or outermost inclined louver 136*n* of 19½ inches diameter, whereby the outer louvered baffle 132 is effective for generating air streams of the type illustrated in Table 1.

While the inclined louvers 136*a* through 136*n* are illustrated herein as being substantially parallel, they are optionally slightly inclined each louver 136*a* relative to the next adjacent louver 136*b* such that the inclination from vertical increases gradually between the innermost inclined louver 136*a* to the outermost inclined louver 136*n*.

The concentric inclined louvers 136*a* through 136*n*, are uniformly angled radially outward at an angle b from the vertical. According to one embodiment of the invention, the angle b is about 45 degrees plus or minus 15 degrees, or between 30 and 60 degrees. However, other shapes of concentric inclined louver 136*a* through 136*n* may be equivalent for effectively deflecting the air stream radially outwardly of the space between the shroud lip 104 and the floor and simultaneously imparting laminar flow characteristics to the air stream. By example and without limitation, the concentric inclined louvers 136*a* through 136*n* may be replaced with equivalent inclined tubes angled at 30 to 60 degrees from the vertical, or alternatively with equivalent curved tubes that radially or angularly change inclination from the vertical to horizontal and direct the air stream parallel with the work surface. Alternatively, the substantially planar concentric inclined louvers 136*a* through 136*n* may be replaced with equivalent curved members that operate similarly to the planar members by providing inlet and output surfaces respectively at the upstream and downstream sides of the grille 128, the inlet and outlet surfaces may be angled as shown for the planar members, or may be respectively vertical and horizontal to more effectively deflect the air stream and impart the desired laminar flow characteristic.

The inner tubular and outer inclined concentric louvers 134*a* through 134*m* and 136*a* through 136*n* are made as thin as practical to avoid disrupting the air stream where it contacts the louver end surfaces. The inner and outer concentric louvers 134*a* through 134*m* and 136*a* through 136*n* are made long relative to their thickness to more effectively impart the desired laminar flow character to the air stream. By example and without limitation, when manufactured from ABS plastic both the inner tubular and outer inclined concentric louvers 134*a* through 134*m* and 136*a* through 136*n* are about 3/32 inch thick and ⅜ inch long as measured along the axis of the grille 128, with the inclined louvers 136*a* through 136*n* being about ⅝ inch long as measured along the inclined wall surface, such that, when operated with the fan 100 of the present invention illustrated in FIG. 9 and described herein, the grille 128 is effective for generating air streams of the type illustrated in Table 1.

The multiple inner vertical tubular louvers 134*a* through 134*m* of the vertical center baffle 130 and the multiple outer angularly inclined louvers 136*a* through 136*n* are all interconnected by multiple radial connectors 140 that may extend the entire vertical length of the louvers 134*a* through 134*m* and 136*a* through 136*n*, as illustrated in FIG. 18. For ease of manufacturing and other considerations discussed herein, the radial connectors 140 are optionally constructed with thickness and length dimensions similar to the inner tubular louvers 134*a* through 134*m*.

Figure 19:
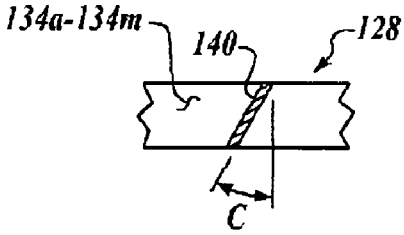
FIG. 19 is another cross-section taken through the louvered fan grille of FIG. 17 and illustrates one optional embodiment of the present invention.

FIG. 19 is a cross-section taken through the radial connector 140 shown in FIG. 17 and illustrates one embodiment of the present invention wherein one or more of the radial connectors 140 optionally provides an air deflecting plate surface 142 that is angularly inclined at an angle c from the vertical in such manner as to impart a circular or "swirling" motion to the air stream within the area occupied by the center baffle 130. Accordingly, the angularly inclined air deflecting plate surface 142 of the radial connectors 140 operate in combination with the fan impeller 106 to generate a swirling "tornado-like" air stream within the normally "dead" space, i.e., zone D of the prior art fan 11, directly down stream of, i.e., below, the fan 100 at the center of the impellers 106. The radially connectors 140 having angularly inclined air deflecting plate surface 142 are used either alone or in combination with the multiple inner concentric vertically tubular louvers 134*a* through 134*m* to drive a portion of the air stream into the directly down stream of the fan 100 at the center of the impellers 106.

While the preferred embodiment of the invention has been illustrated and described, it will be appreciated that various changes can be made therein without departing from the spirit and scope of the invention. For example, materials such as different plastics and metals may be substituted for the different components of the louvered fan grille apparatus 128 of the invention without departing from the spirit and scope of the invention. Therefore, the inventor makes the following claims.

What is claimed is:

1. A method for drying, comprising:

with a fan positioned within a confined space, generating an air stream within the confined space;

positioning a terminal lip surface of the confined space relatively stationary with respect to a substantially flat work surface to be dried, wherein the terminal lip surface is further defined by a periphery of the confined space adjacent to a terminus thereof and being offset a substantially constant distance in the range of two to five inches from the work surface;

exhausting the air stream from the confined space into a downstream zone defined between the confined space and the work surface and substantially bounded by the terminal lip surface;

directing the exhausted air stream across the work surface to be dried; and exhausting the air stream from the downstream zone into ambient air space external of the terminal lip surface as an air stream positioned adjacent to the work surface.

2. The method of claim 1 wherein exhausting the air stream from the downstream zone further comprises exhausting the air stream in a substantially radial pattern relative to the confined space, the radial pattern being substantially continuous adjacent to the lip surface.

3. The method of claim 2, further comprising substantially uniformly spacing the lip surface relative to the work surface to be dried.

4. The method of claim 2, further comprising positioning a fan grille adjacent to the lip surface, the grille directing a central portion the air stream substantially normal to a portion of to the work surface positioned opposite from the lip surface and substantially central thereof, and directing an annular portion of the air stream crosswise to the work surface.

5. The method of claim 3 wherein exhausting the air stream between the work surface and a lip surface offset a distance from the work surface as an air stream positioned adjacent to the work surface further comprises substantially confining the exhausted air stream within an envelope positioned adjacent to the work surface and having a thickness substantially equivalent to the offset distance between the lip surface and the work surface.

6. The method of claim 3 wherein exhausting the air stream from the downstream zone further comprises exhausting the air stream into ambient air space external of the lip surface as a substantially laminar air stream, and further the exhausted air stream substantially decaying upon contact with an upright obstruction.

7. The method of claim 3, further comprising exhausting a central portion the air stream substantially normal to a portion of to the work surface positioned opposite from the lip surface and substantially central thereof.

8. The method of claim 5, further comprising extending the envelope containing the air stream for a minimum radial distance of approximately six feet externally of the downstream zone.

9. The method of claim 3, further comprising positioning the fan within a substantially tubular confined space.

10. The method of claim 9, further comprising extending the envelope containing the air stream into ambient air space for a minimum radial distance of approximately six feet.

11. A method for drying, comprising:

with a fan positioned within a confined space, generating an air stream within the confined space;

positioning a peripheral lip surface of the confined space substantially perpendicular to a substantially flat and relatively stationary work surface to be dried and spaced away from the work surface an offset distance in the range of two to five inches;

directing the air stream substantially crosswise to the work surface to be dried; and exhausting the air stream from the confined space between the work surface and the peripheral lip surface of the confined space and into ambient air space in a substantially radial pattern positioned substantially adjacent to the work surface.

12. The method of claim 11 wherein exhausting the air stream between the work surface and the peripheral lip surface further comprises substantially confining the exhausted air stream within an envelope positioned adjacent to the work surface and having a thickness substantially equivalent to the offset distance between the lip surface and the work surface.

13. The method of claim 11, further comprising positioning a fan grille adjacent to the lip surface, the grille directing a central portion the air stream substantially normal to a portion of to the work surface positioned opposite from the lip surface and substantially central thereof, and directing an annular portion of the air stream crosswise to the work surface.

14. The method of claim 11 wherein exhausting the air stream between the work surface and lip surface further comprises exhausting the air stream as a substantially laminar air stream.

15. The method of claim 14 wherein exhausting the air stream as a substantially laminar air stream further comprises causing the exhausted air stream to decay upon contact with an upright obstruction.

16. The method of claim 11, further comprising exhausting a central portion the air stream substantially normal to a portion of to the work surface positioned opposite from the lip surface and substantially central thereof.

17. The method of claim 11, further comprising substantially uniformly spacing the lip surface relative to the work surface to be dried.

18. The method of claim 14 wherein exhausting the air stream as a substantially laminar air stream positioned adjacent to the work surface further comprises exhausting the air stream as a substantially laminar air stream positioned adjacent to the work surface.

* * * * *